US008462188B2

(12) United States Patent
Shimomura

(10) Patent No.: US 8,462,188 B2
(45) Date of Patent: Jun. 11, 2013

(54) OPTICAL SCANNING APPARATUS AND IMAGE FORMING APPARATUS USING THE SAME

(75) Inventor: Hidekazu Shimomura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 139 days.

(21) Appl. No.: 12/786,123

(22) Filed: May 24, 2010

(65) Prior Publication Data

US 2010/0226686 A1 Sep. 9, 2010

Related U.S. Application Data

(63) Continuation of application No. 12/243,794, filed on Oct. 1, 2008, now Pat. No. 7,750,931.

(30) Foreign Application Priority Data

Oct. 9, 2007 (JP) ..... 2007-263057

(51) Int. Cl.
*B41J 15/14* (2006.01)
*B41J 27/00* (2006.01)

(52) U.S. Cl.
USPC ..... 347/241; 347/256

(58) Field of Classification Search
USPC ..... 347/230–233, 241–244, 256–261
See application file for complete search history.

(56) References Cited

U.S. PATENT DOCUMENTS

| | | | | |
|---|---|---|---|---|
| 4,962,312 | A * | 10/1990 | Matuura et al. | 250/236 |
| 5,534,990 | A * | 7/1996 | Harris | 399/223 |
| 7,224,503 | B2 * | 5/2007 | Takayama | 359/204.1 |
| 7,750,931 | B2 * | 7/2010 | Shimomura | 347/241 |
| 2006/0256185 | A1 * | 11/2006 | Suzuki et al. | 347/256 |

FOREIGN PATENT DOCUMENTS

| | | | |
|---|---|---|---|
| JP | 2004-205640 | A | 7/2004 |
| JP | 2004-294640 | A | 10/2004 |

* cited by examiner

*Primary Examiner* — Hai C Pham
(74) *Attorney, Agent, or Firm* — Canon U.S.A., Inc. I.P. Division

(57) ABSTRACT

Light sources emit light beams onto deflecting surfaces of a deflecting unit through incident optical systems. The deflecting unit deflects the light beams in a uniform direction to form images onto different surfaces to be scanned through imaging optical systems. An optical path length, or a distance from a deflection point of the deflecting unit to a surface to be scanned, of an imaging optical system to form an image onto a surface to be scanned closest to the deflecting unit is different from that of an imaging optical system to form an image onto a surface to be scanned farthest from the deflecting unit. Also, the following condition is satisfied:

$$0.85<K_1/K_2<0.98$$

where $K_1$ is a Kθ coefficient of an imaging optical system with a short optical path length, and $K_2$ is that of an imaging optical system with a long optical path length.

5 Claims, 26 Drawing Sheets

OPTICAL SCANNING APPARATUS AND IMAGE FORMING APPARATUS USING THE SAME

CROSS-REFERENCE TO RELATED APPLICATIONS

This application is a continuation of U.S. patent application Ser. No. 12/243,794 filed Oct. 1, 2008, which claims priority to Japanese Patent Application No. 2007-263057 filed Oct. 9, 2007, each of which is hereby incorporated by reference herein in its entirety.

BACKGROUND OF THE INVENTION

1. Field of the Invention

The present invention relates to an optical scanning apparatus which may be particularly employed by an image forming apparatus, such as a laser beam printer (LBP), a digital copier, or a multi-function printer, having an electrophotographic process. The present invention also relates to an image forming apparatus that uses the optical scanning apparatus.

2. Description of the Related Art

Hitherto, an optical scanning apparatus has been used for a LBP, a digital copier, a multi-function printer, or the like.

In the optical scanning apparatus, a light source modulates and emits a light beam in accordance with an image signal, and a light deflector, which is, for example, a rotatable polygonal mirror (polygonal mirror), periodically deflects the light beam.

Then, an imaging optical system (scanning optical system) having an fθ characteristic condenses the deflected light beam onto a surface of a photosensitive recording medium (photosensitive drum) in a spot-like form, so that the light beam scans the surface for image recording.

FIG. 21 is a schematic illustration showing a primary portion of an optical scanning apparatus according to a related art example.

Referring to FIG. 21, a light source 1 emits a single or plurality of divergent light beams. A collimator lens 2 converts the light beams into a single or plurality of parallel light beams. An aperture stop 3 limits the light beams. The light beams are incident on a cylindrical lens 4 having a specific refractive power only in a sub-scanning direction.

From among the parallel light beams incident on the cylindrical lens 4, light beams within a main-scanning cross section are directly exited from the cylindrical lens 4 without any change.

Light beams within a sub-scanning cross section are condensed and form linear images onto a deflecting surface (reflection surface) 5*a* of a light deflector 5 which is a polygonal mirror.

The light beams deflected by the deflecting surface 5*a* of the light deflector 5 are guided onto a photosensitive drum surface 8 serving as a surface to be scanned, through an imaging lens 6 having an fθ characteristic.

The light deflector 5 is rotated in a direction indicated by arrow A, so that the single or plurality of light beams scan the photosensitive drum surface 8 in a direction indicated by arrow B (main-scanning direction) to record image information.

Referring to FIG. 21, reference numeral 18 denotes a mirror for synchronism detection, and 19 denotes a sensor for synchronism detection.

As optical scanning apparatuses for color image forming apparatuses that form color images, various optical scanning apparatuses have been suggested in which a light deflector serving as a deflecting unit is shared by a plurality of light beams for reduction in size of the entire apparatus (for example, see Japanese Patent Laid-Open No. 2002-055293).

FIG. 22 is a schematic illustration showing a primary portion of an optical scanning apparatus for a color image forming apparatus according to a related art example in which a light deflector is shared by a plurality of light beams.

The optical scanning apparatus in FIG. 22 includes scanning units SR and SL disposed on both sides with a light deflector 5 interposed therebetween. Vertically arranged two light beams are obliquely incident on a single deflecting surface within a sub-scanning cross section.

In the scanning unit SR on the one side of the light deflector 5, a plurality of light beams deflected by the light deflector 5 scan two photosensitive drum surfaces 8A and 8B (surfaces to be scanned) in a uniform direction.

In the scanning unit SL on the other side, a plurality of light beams deflected by the light deflector 5 scan two photosensitive drum surfaces 8C and 8D in a uniform direction.

The scanning units SR and SL in FIG. 22 each use a common imaging optical system (scanning optical system) for vertically arranged light beams Ra and Rb.

In the imaging optical system, an optical path of the light beam Rb that forms an image onto each of the photosensitive drum surfaces 8B and 8C located close to the light deflector 5 is reflected with the use of three reflection mirrors, so as to prevent the light beam Rb from interfering with optical components such as a lens and a mirror.

When the number of reflection mirrors is increased, stripes may likely appear in an image due to dusts adhering to the mirrors and scars of the mirrors.

In addition, banding of scanning lines due to vibration of the mirrors may become noticeable. Further, as the number of mirrors is increased, the entire apparatus may be complicated.

Thus, it is desirable to form the optical scanning apparatus with a minimum number of reflection mirrors.

FIG. 23 is a sub-scanning cross section of the optical scanning apparatus in FIG. 22 when the number of reflection mirrors is two in the imaging optical system SB that forms images onto the photosensitive drum surfaces 8B and 8C located close to the light deflector 5 (i.e., that scans the photosensitive drum surfaces).

It is found that the light beams Ra that form images onto the photosensitive drum surfaces 8A and 8D located far from the light deflector 5 interfere with imaging lenses for forming images onto the photosensitive drum surfaces 8B and 8C located close to the light deflector 5.

To avoid this, the positions of the imaging lenses and the reflection mirrors may be changed. However, it is difficult to attain this within a predetermined limited space of a main body of the color image forming apparatus.

Thus, as shown in FIG. 23, the number of reflection mirrors is increased, and the optical path is properly reflected in the given space in the known configuration, although problems such as stripes in an image and banding remain.

Japanese Patent Laid-Open No. 2002-055293 discloses an optical scanning apparatus capable of saving the space by using different imaging optical systems for light beams that form images onto different surfaces to be scanned.

FIG. 24 is a sub-scanning cross section disclosed in Japanese Patent Laid-Open No. 2002-055293.

In the drawing, an optical scanning apparatus is illustrated, in which a single reflection mirror is used in each of the imaging optical system SB that forms images onto the photosensitive drum surfaces 8B and 8C located close to the light deflector 5 and the imaging optical system SA that forms images onto the photosensitive drum surfaces 8A and 8D located far from the light deflector 5.

In the known optical scanning apparatus for the color image forming apparatus, the following problems are present.

Referring to FIGS. 22 and 23, in the known configuration using the common imaging optical system for the vertically arranged light beams Ra and Rb, the freedom of arrangement of optical components is restricted. The number of mirrors is increased as shown in FIG. 22, and interference of light beams with optical components occurs as shown in FIG. 23.

In particular, the above-mentioned problems may occur when an imaging optical system has a configuration in which the imaging lens located closest to the photosensitive drum surfaces 8A and 8D in the imaging optical system SA that forms images onto the photosensitive drum surfaces 8A and 8D located farthest from the light deflector 5 is disposed closer to the light deflector 5 than the reflection mirror located closest to the photosensitive drum surfaces 8A and 8D is.

In contrast, the optical scanning apparatus disclosed in Japanese Patent Laid-Open No. 2002-055293 having the different imaging optical systems SA and SB for the plurality of light beams has the configuration in which the optical path is reflected by the single reflection mirror in each of the imaging optical systems SA and SB.

Accordingly, a large difference, which is as large as a distance between the surfaces to be scanned, is generated between an optical path length of the imaging optical system SB that forms images onto the photosensitive drum surfaces 8B and 8C located close to the light deflector 5 and an optical path length of the imaging optical system SA that forms images onto the photosensitive drum surfaces 8A and 8D located far from the light deflector 5.

Herein, an optical path length is an optical distance from a deflection point of a light deflector to a surface to be scanned. Also, in the specification, the term "optically" represents "in a condition where an optical path is developed".

Since the light beam is incident on a plane perpendicular to the deflecting surface of the light deflector 5 within the sub-scanning cross section, the optical system has to sufficiently correct deformation of a spot as a result of torsion of wavefront aberration.

However, in the two imaging optical systems SA and SB, in which the imaging lens located close to the light deflector 5 is shared, and the large difference as the distance between the surfaces to be scanned is present, it is difficult to correct the torsion of wavefront aberration and to satisfy other paraxial performances.

SUMMARY OF THE INVENTION

The present invention provides a compact optical scanning apparatus in which the freedom of arrangement of optical components is enhanced and the number of optical components is reduced, and an image forming apparatus using the same.

An optical scanning apparatus according to an aspect of the present invention includes a plurality of light sources; a deflecting unit having a deflecting surface, the deflecting surface configured to deflect a plurality of light beams emitted from the light sources; and a plurality of imaging optical systems provided in correspondence with the light beams deflected for scanning by the deflecting surface of the deflecting unit. The imaging optical systems respectively form such light beams onto corresponding surfaces to be scanned. The deflecting unit deflects the light beams so that the light beams scan the surfaces to be scanned in a uniform direction in the imaging optical systems. Defining an optical path length of an imaging optical system to be an optical distance from a deflection point of the deflecting unit to the corresponding surface to be scanned, an optical path length of an imaging optical system configured to form an image onto a surface to be scanned located physically closest to the deflecting unit is different from an optical path length of an imaging optical system configured to form an image onto a surface to be scanned located physically farthest from the deflecting unit, and the following condition is satisfied:

$$0.85<K_1/K_2<0.98$$

where $K_1$ is a Kθ coefficient of an imaging optical system with a short optical path length from among the imaging optical systems, and $K_2$ is a Kθ coefficient of an imaging optical system with a long optical path length from among the imaging optical systems.

An image forming apparatus according to another aspect of the present invention includes the above-described optical scanning apparatus; a plurality of photosensitive members disposed at the surfaces to be scanned; a plurality of developing units configured to develop electrostatic latent images, which are formed on the photosensitive members with light beams for scanning by the optical scanning apparatus, into toner images; a plurality of transferring units configured to transfer the developed toner images onto a printable member; and a fixing unit configured to fix the transferred toner images to the printable member.

An optical scanning apparatus according to still another aspect of the present invention includes a plurality of light sources; a deflecting unit having a deflecting surface, the deflecting surface configured to deflect a plurality of light beams emitted from the light sources for scanning; and a plurality of imaging optical systems provided in correspondence with the light beams deflected by the deflecting surface of the deflecting unit, for scanning. The imaging optical systems respectively form such light beams onto corresponding surfaces to be scanned. The deflecting unit deflects the light beams so that the light beams scan the surfaces to be scanned in a uniform direction in the imaging optical systems. Defining an optical path length of an imaging optical system to be an optical distance from a deflection point of the deflecting unit to a corresponding surface to be scanned, optical path lengths of the imaging optical systems are different from each other. When $K_1$ is a Kθ coefficient of an imaging optical system with a short optical path length from among the imaging optical systems, and $K_2$ is a Kθ coefficient of an imaging optical system with a long optical path length from among the imaging optical systems, $K_2$ is larger than $K_1$.

An image forming apparatus according to yet another aspect of the present invention includes the above-described optical scanning apparatus; a plurality of photosensitive members disposed at the surfaces to be scanned; a plurality of developing units configured to develop electrostatic latent images, which are formed on the photosensitive members with light beams for scanning by the optical scanning apparatus, into toner images; a plurality of transferring units configured to transfer the developed toner images onto a printable member; and a fixing unit configured to fix the transferred toner images to the printable member.

With any of the embodiments of the present invention, a compact optical scanning apparatus in which the freedom of arrangement of optical components is enhanced and the number of optical components is reduced, as well as an image forming apparatus using the same, can be provided.

Further features of the present invention will become apparent from the following description of exemplary embodiments with reference to the attached drawings.

DESCRIPTION OF THE EMBODIMENTS

Regarding the present invention, an optical path length is an optical distance from a deflection point of a light deflector to a surface to be scanned.

Also, regarding the present invention, the term "optically" represents "in a condition where an optical path is developed".

Hereinafter, embodiments of the present invention are described with reference to the attached drawings.

First Embodiment

Figure 1:
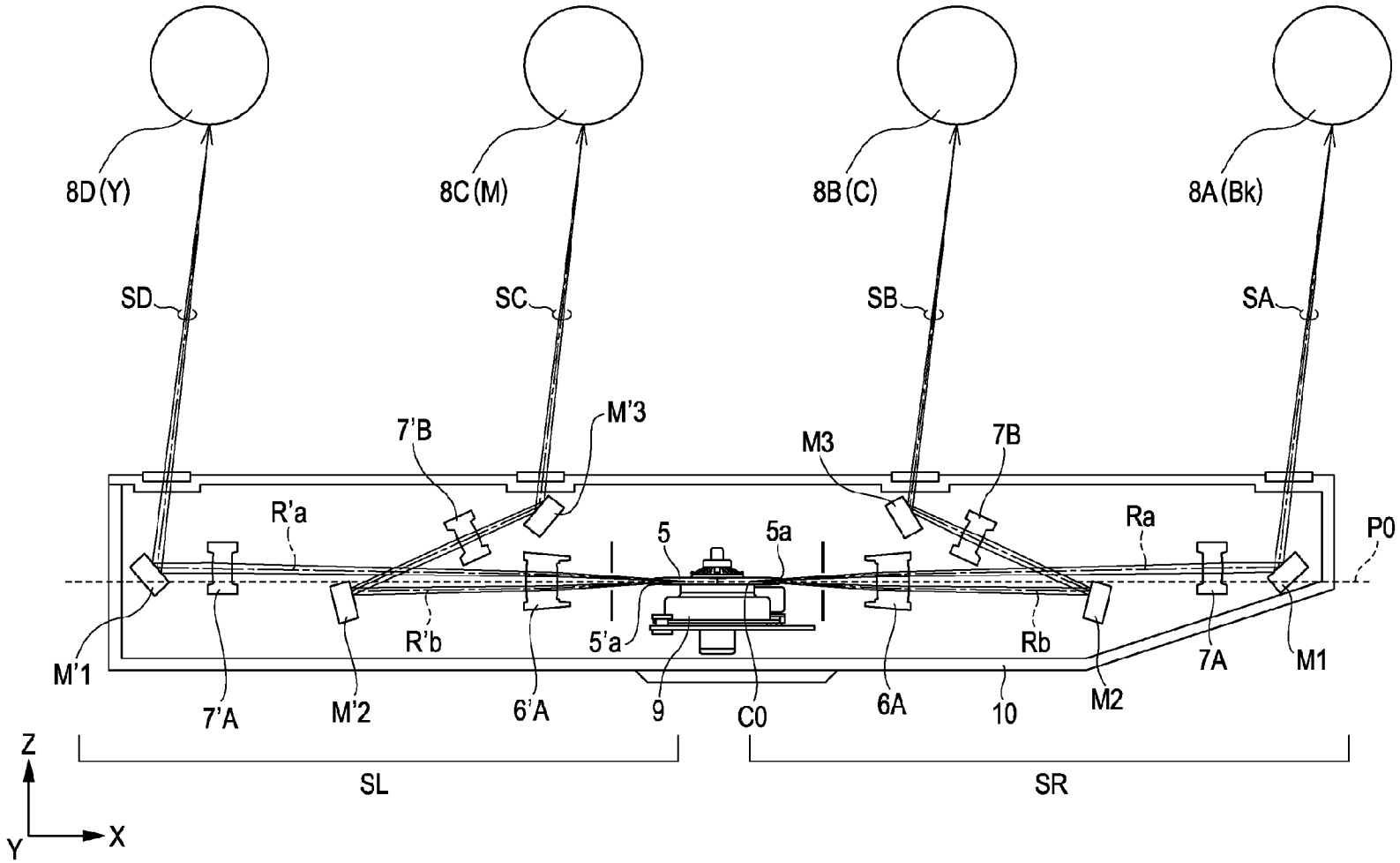
FIG. 1 illustrates a sub-scanning cross section of an optical scanning apparatus according to a first embodiment of the present invention.

FIG. 1 illustrates a cross section of a primary portion of an optical scanning apparatus in a sub-scanning direction (sub-scanning cross section) according to a first embodiment of the present invention.

In the following description, the expression "an optical axis or an axis of an imaging optical system (scanning optical system)" is an axis being located at the center of a surface to be scanned and perpendicular to the surface to be scanned. In addition, the expression "an optical axis of a lens" is a straight line connecting a surface vertex of an incident surface and a surface vertex of an exit surface of the lens.

In the description, a main-scanning direction (Y direction) is a direction in which a light beam is deflected by a deflecting surface of a light deflector.

A sub-scanning direction (Z direction) is a direction parallel to a rotation axis of the light deflector.

A main-scanning cross section is a plane with a normal in the sub-scanning direction (Z direction).

A sub-scanning cross section is a plane with a normal in the main-scanning direction (Y direction).

An optical scanning apparatus of this embodiment includes two scanning units SR and SL with a light deflector (deflecting unit) 5 interposed therebetween. The single light deflector 5 deflects four light beams Ra, Rb, R'a, and R'b to scan surfaces of corresponding photosensitive drum surfaces 8A (Bk), 8B (C), 8C (M), and 8D (Y).

In the scanning unit SR, a deflected light beam Ra, which is deflected and reflected by a deflecting surface 5*a* of the light deflector (five-sided polygonal mirror) 5 serving as the deflecting unit, passes through imaging lenses 6A and 7A, is reflected by a reflection mirror M1, and is guided to the photosensitive drum surface 8A (Bk) serving as a surface to be scanned.

A deflected light beam Rb, which is deflected for scanning by the deflecting surface 5*a* of the light deflector 5 serving as a rotatable polygonal mirror, passes through the imaging lens 6A, is reflected by a reflection mirror M2, passes through an imaging lens 7B, is reflected by a reflection mirror M3, and is guided to the photosensitive drum surface 8B (C) serving as a surface to be scanned.

In the scanning unit SL, a deflected light beam R'a, which is deflected and reflected by a deflecting surface 5'*a* of the light deflector 5, passes through imaging lenses 6'A and 7'A, is reflected by a reflection mirror M'1, and is guided to the photosensitive drum surface 8D (Y) serving as a surface to be scanned.

A deflected light beam R'b, which is deflected for scanning by the deflecting surface 5'*a* of the light deflector 5, passes through the imaging lens 6'A, is reflected by a reflection mirror M'2, passes through an imaging lens 7'B, is reflected by a reflection mirror M'3, and is guided to the photosensitive drum surface 8C (M) serving as a surface to be scanned.

In the following description, optical systems that form images onto the photosensitive drum surfaces 8A and 8D (optical systems that scan surfaces to be scanned) located physically farthest from the light deflector 5 are called imaging optical systems SA and SD.

Also, optical systems that form images onto the photosensitive drum surfaces 8B and 8C (optical systems that scan surfaces to be scanned) located physically closest to the light deflector 5 are called imaging optical systems SB and SC.

The expression "being closest to the light deflector 5" is being closest to a deflecting surface of the light deflector 5 in view of a physical configuration. The expression "being farthest from the light deflector 5" is being farthest from a deflecting surface of the light deflector 5 in view of a physical configuration.

That is, for example, a physical distance is a distance when a photosensitive drum surface 8 and the light deflector 5 are connected with a straight line.

The two scanning units SR and SL according to this embodiment have similar configurations and optical effects, and hence, the scanning unit SR will be mainly described below.

The plurality of imaging optical systems SA and SB according to this embodiment each include the plurality of imaging lenses. The imaging lens 6A arranged optically closest to the light deflector 5 is shared by the plurality of imaging optical systems SA and SB.

Also, in this embodiment, the number of mirrors in the imaging optical system SB that forms an image onto the photosensitive drum surface 8B located physically closest to the light deflector 5 is larger than the number of mirrors in the imaging optical system SA that forms an image onto the photosensitive drum surface 8A located physically farthest from the light deflector 5.

In this embodiment, the imaging lens 7A arranged optically closest to the photosensitive drum surface 8A of the imaging optical system SA that forms an image onto the photosensitive drum surface 8A located physically farthest from the light deflector 5 is disposed closer to the light deflector 5 (deflecting unit) than the reflection mirror M1 arranged optically closest to the photosensitive drum surface 8A is.

Accordingly, the length of the imaging lens 7A in the main-scanning direction is decreased, thereby promoting reduction in size of the entire apparatus.

If the imaging lens 7A arranged optically closest to the photosensitive drum surface 8A is disposed closer to the photosensitive drum surface 8A than the reflection mirror M1 arranged optically closest to the photosensitive drum surface 8A is, the above-mentioned interference between the scanning light beam and the imaging lens 7A can be avoided.

However, since the length of the imaging lens 7A in the main-scanning direction is increased; the size of the entire apparatus is increased.

Figure 23:
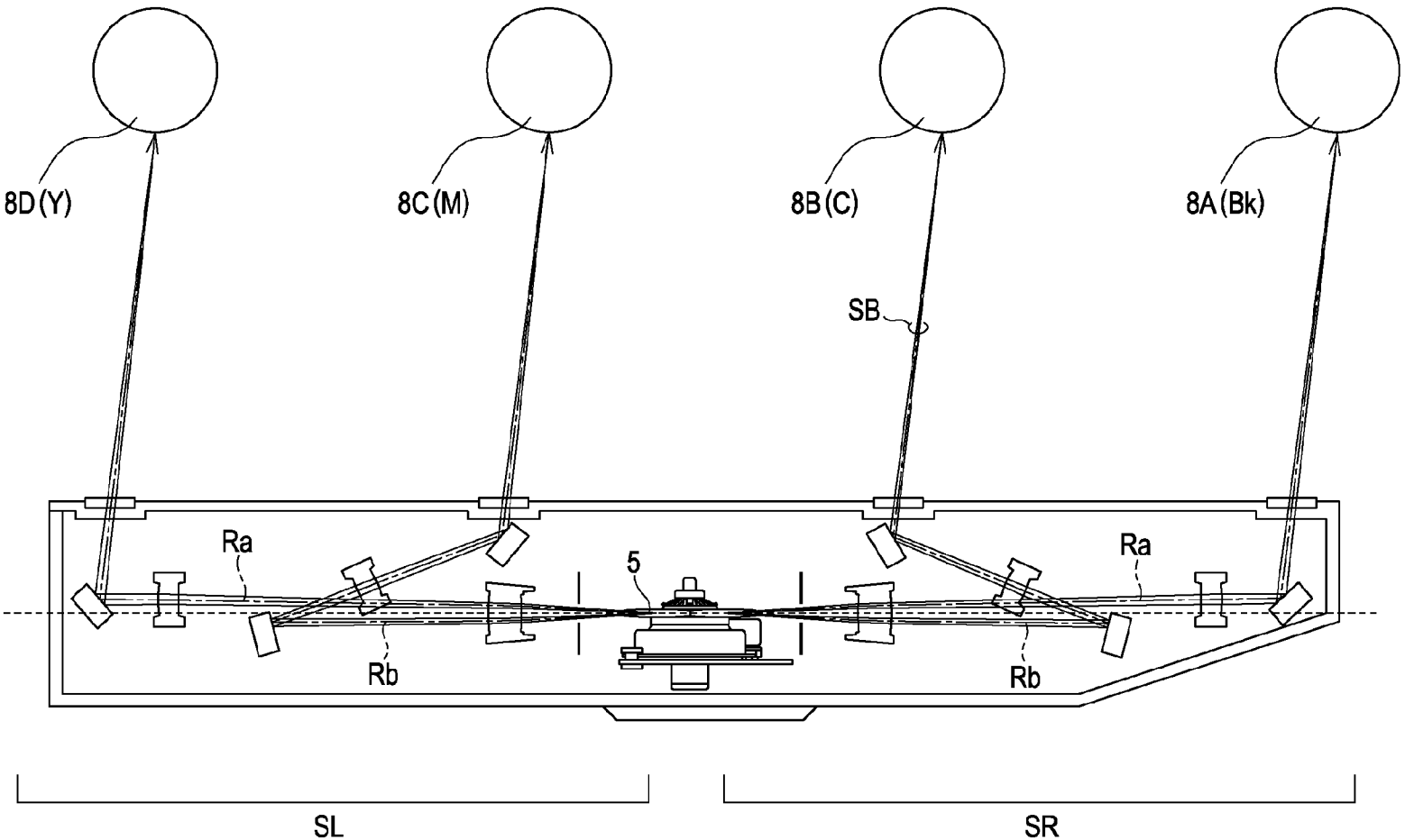
FIG. 23 PRIOR ART
FIG. 23 illustrates a sub-scanning cross section of an optical scanning apparatus according to a related art example.
Figure 24:
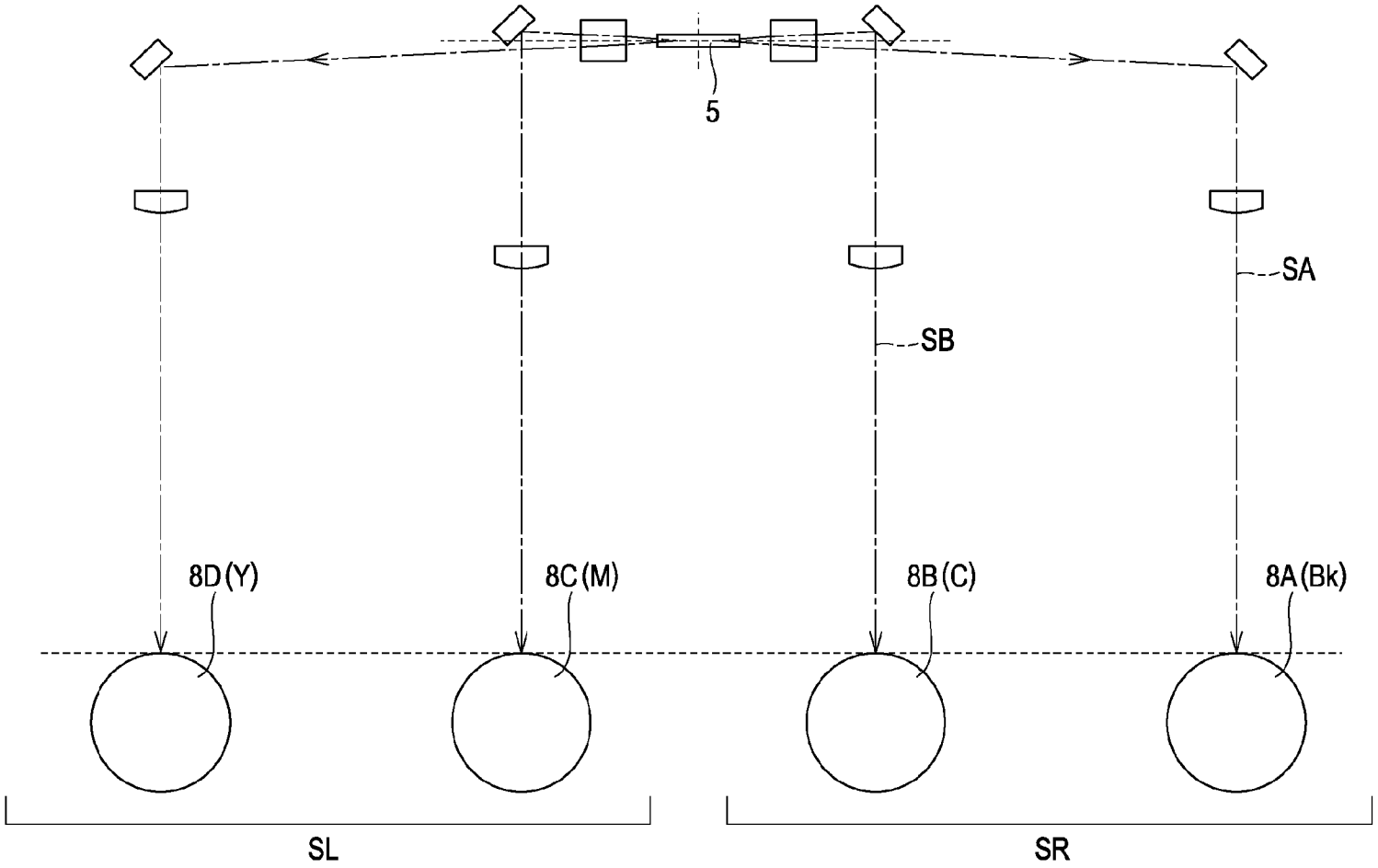
FIG. 24 PRIOR ART
FIG. 24 illustrates a sub-scanning cross section of an optical scanning apparatus according to a related art example.

This embodiment employs an optical arrangement in which the light beam Rb does not intersect with the same light beam within the sub-scanning cross section as shown in FIG. 1. In such a case, the optical path length of the light beam Rb is set smaller than the optical path length of the light beam Ra. Hence, the imaging lens 7B is arranged closer to the photosensitive drum surface 8B. Accordingly, the interference between the lens and the light beam, which has been a bottleneck when the imaging lens 6A is shared as shown in FIG. 23, can be avoided.

Figure 2A:
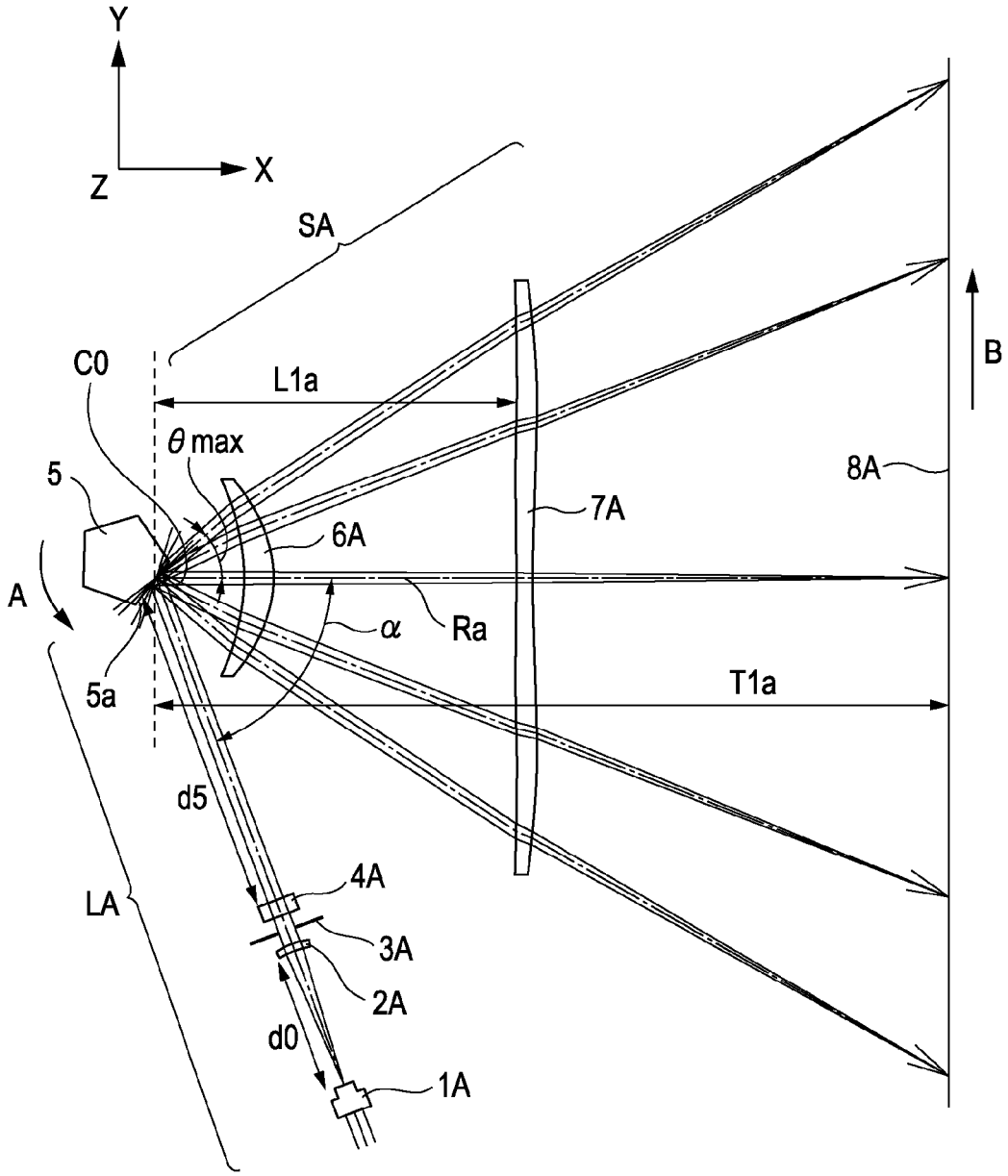
FIG. 2A illustrates a main-scanning cross section of the optical scanning apparatus according to the first embodiment of the present invention.
Figure 2B:
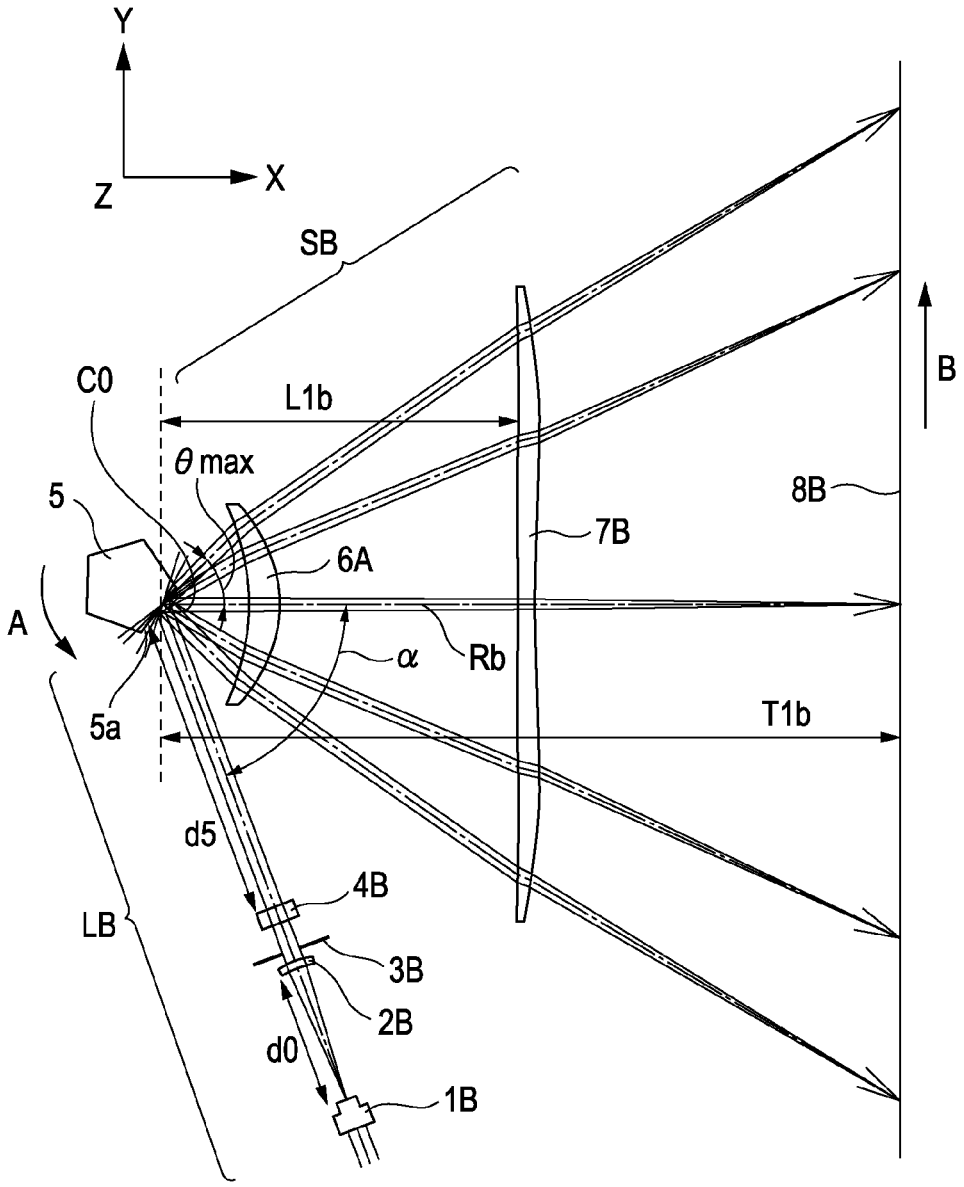
FIG. 2B illustrates a main-scanning cross section of the optical scanning apparatus according to the first embodiment of the present invention.

FIG. 2A illustrates a main-scanning cross section of the imaging optical system SA for the light beam Ra from among the light beams Ra and Rb to be deflected for scanning to the same side by the light deflector 5. FIG. 2B illustrates a main-scanning cross section of the imaging optical system SB for the light beam Rb.

In this embodiment, the imaging lens 6A located close to the light deflector 5 has an equivalent shape in the imaging optical systems SA and SB, and the imaging lenses 7A and 7B located close to the photosensitive drum surfaces 8A and 8B have different shapes in the main-scanning cross section and the sub-scanning cross section.

In the drawings, reference character C0 denotes a deflection point (reference point) of a principal ray of an axial light beam.

In the sub-scanning direction, the light beams Ra and Rb intersect with each other at the deflection point C0.

The deflection point C0 is a reference point of an imaging optical system. A distance in which a light beam progresses from a deflection point C0 to a surface to be scanned is hereinafter referred to as "an optical path length of an imaging optical system".

Referring to these drawings, the optical path lengths of the two imaging optical systems SA and SB are different in this embodiment, so that the freedom of arrangement of optical components is enhanced.

Herein, when reference character T1*a* denotes the optical path length of the imaging optical system SA in FIG. 2A, and T1*b* denotes the optical path length of the imaging optical system SB in FIG. 2B, the optical path lengths are determined as follows:

$$T1a = 246 \text{ mm, and}$$

$$T1b = 231.9 \text{ mm}$$

Thus, the difference between these optical path lengths is 14.1 mm.

To obtain such a difference between the optical path lengths, a ratio K (Kθ coefficient, Y=Kθ) of a scanning field angle θ (rad) to a scanning image height Y (mm), and a convergence m in the main-scanning direction of a light beam to be incident on a deflecting surface 5*a* of the light deflector 5 in the imaging optical system SA may be different from those in the imaging optical system SB.

Here, the convergence m is expressed as follows:

$$m=1-Sk/f$$

where Sk is a distance (mm) from a rear principal plane to a surface to be scanned within the main-scanning cross section of any imaging optical system, and f is a focal length (mm) within the main-scanning cross section of that imaging optical system.

The condition is classified into three conditions as follows depending on the value of m:

When m=0, parallel light beams are incident on the light deflector in the main-scanning direction.

When m<0, divergent light beams are incident on the light deflector in the main-scanning direction.

When m>0, convergent light beams are incident on the light deflector in the main-scanning direction.

In this embodiment, when reference character Ka denotes a Kθ coefficient and ma denotes a convergence of the imaging optical system SA for the light beam Ra, and when Kb denotes a Kθ coefficient and mb denotes a convergence of the imaging optical system SB for the light beam Rb, respective parameters are determined as follows:

$$Ka=210.0\ (\text{mm/rad}), ma=-0.003$$

$$Kb=199.1614\ (\text{mm/rad}), mb=0.075$$

Thus, when reference character $K_1$ denotes a Kθ coefficient of the imaging optical system SB with the short optical path length, and $K_2$ denotes a Kθ coefficient of the imaging optical system SA with the long optical path length, these are expressed as follows:

$$K_1/K_2=Kb/Ka=0.9484$$

That is, in this embodiment, it is found that $K_2$ is longer than $K_1$ when reference character $K_1$ denotes the Kθ coefficient of the imaging optical system SB with the short optical path length from among the plurality of imaging optical systems, and $K_2$ denotes the Kθ coefficient of the imaging optical system SA with the long optical path length from among the plurality of imaging optical systems.

This satisfies Conditional expression (1) as follows:

$$0.85<K_1/K_2<0.98 \quad (1)$$

Conditional expression (1) relates to a ratio of the Kθ coefficient $K_1$ of the imaging optical system SB with the short optical path length to the Kθ coefficient $K_2$ of the imaging optical system SA with the long optical path length. If the value is above the upper limit of Conditional expression (1), the freedom of arrangement of optical components is restricted.

When the value is below the lower limit of Conditional expression (1), design with the common imaging lens 6A may be difficult.

In particular, it is difficult to satisfy both a curvature of field dm and an fθ characteristic dy1 in the main-scanning direction. Hence, a spot profile may be deformed, and uniformity of an imaging magnification in the sub-scanning direction may be degraded.

More specifically, Conditional expression (1) may be modified as follows:

$$0.87<K_1/K_2<0.96 \quad (1a)$$

As described above, if the configuration satisfies Conditional expression (1), and more particularly, Conditional expression (1a), a further desirable optical performance can be obtained while the freedom of arrangement is enhanced.

Also, the convergence m in each of the imaging optical systems SA and SB satisfies Conditional expression (2) as follows:

$$|m|<0.2 \quad (2)$$

Conditional expression (2) defines the convergence m. If the value does not satisfy Conditional expression (2), a jitter markedly appears in the main-scanning direction as a result of surface decentration of a reflection surface of the light deflector 5.

More specifically, Conditional expression (2) may be modified as follows:

$$|m|<0.15 \quad (2a)$$

The scanning unit SL provided on the other side to deflect a light for scanning with the light deflector 5 in FIG. 1 has a similar optical effect to that of the above-described scanning unit SR. Light beams R'a and R'b of the scanning unit SL are guided to the photosensitive drum surfaces 8D (Y) and 8C (M) serving as surfaces to be scanned.

In this embodiment, light beams emitted from a plurality of light sources are incident on different deflecting surfaces of a single light deflector through corresponding incident optical systems for deflective scanning on both sides with the light deflector interposed therebetween.

Accordingly, an optical scanning apparatus is provided, in which scanning can be performed simultaneously for four colors of yellow (Y), magenta (M), cyan (C), and black (Bk).

Figure 3:
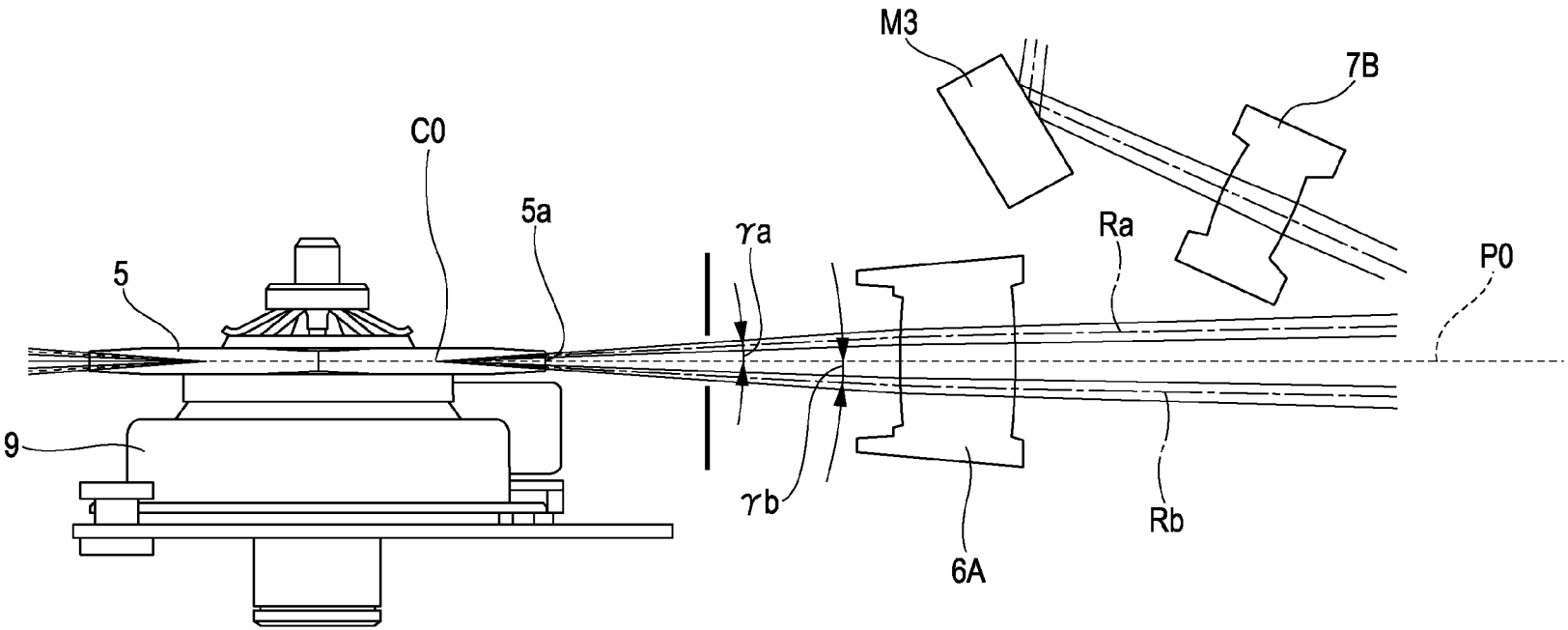
FIG. 3 is an enlarged view illustrating a sub-scanning cross section of the optical scanning apparatus according to the first embodiment of the present invention.

FIG. 3 is an enlarged view showing an area around the light deflector 5 shown in FIG. 1.

Figure 4:
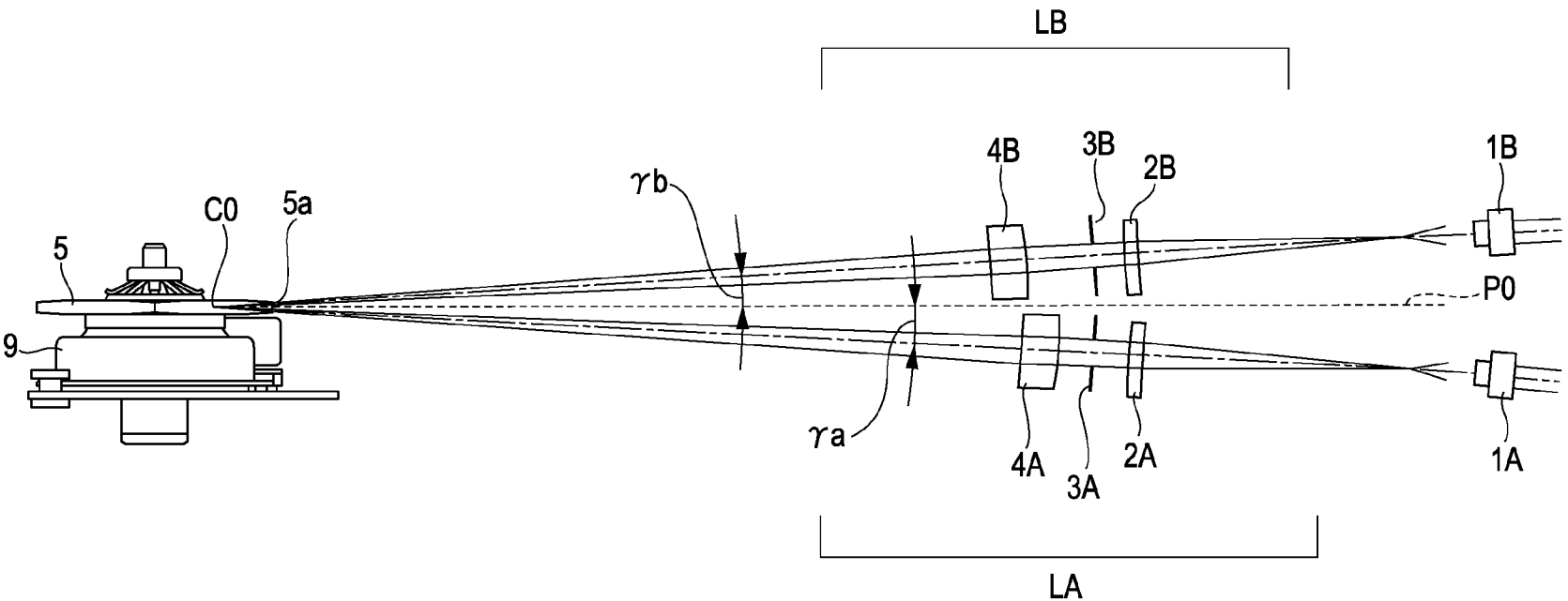
FIG. 4 illustrates a sub-scanning cross section of an incident optical system of the optical scanning apparatus according to the first embodiment of the present invention.

FIG. 4 is a sub-scanning cross section of the incident optical systems of the scanning unit SR.

In this embodiment, when reference character P0 denotes a plane perpendicular to the deflecting surface 5*a* of the light deflector 5 and passing through the reference point C0, light beams having obliquely incident angles of γa=3.3° and γb=3.3° with respect to the plane P0 are deflected for scanning.

If the obliquely incident angles are too large, it is difficult to correct deformation of a spot as a result of torsion of wavefront aberration. If the obliquely incident angles are too small, it is difficult to separate an optical path.

In this embodiment, since the vertically adjacent obliquely incident angles γa and γb are both 3.3°, the optical path is easily separated by the reflection mirror M2.

In this embodiment, the light sources employ semiconductor lasers 1A and 1B. The semiconductor lasers 1A and 1B emit divergent light beams. The coupling lens 2A serving as an incident imaging lens converts the divergent light beams into slightly divergent light beams (m=−0.003).

Also, the coupling lens 2B converts the divergent light beams into slightly convergent light beams (m=0.075).

The cylindrical lenses 4A and 4B serving as incident imaging lenses are temporarily form images with light beams condensed by the coupling lenses 2A and 2B onto the deflecting surfaces 5*a* of the light deflector 5.

The aperture stops 3A and 3B have different diameters in the sub-scanning direction so as to provide equivalent spot diameters ($1/e^2$ slice diameters of peak light powers of spots) on the photosensitive drum surfaces 8A and 8B (the surfaces to be scanned).

Also, in this embodiment, the optical systems (incident optical systems LA and LB) from the semiconductor lasers (light sources) 1A and 1B to the light deflector 5 use common optical components (incident imaging lenses) having equivalent shapes except for the aperture stops 3A and 3B. Hence, the incident optical systems have different distances in the optical-axis direction for optimization.

Since the optical systems have the common optical components, the variation of components is reduced, and the number of units to be produced per component is increased.

To emit light beams with different convergences m with the common optical components, distances d0 from the coupling lenses 2A and 2B to the semiconductor lasers 1A and 1B may be varied.

Also, to temporarily form images of light beams with different convergences m onto the deflecting surfaces 5*a*, distances d5 from the cylindrical lenses 4A and 4B to the deflecting surfaces 5*a* may be varied.

Specific numerical values are shown in Tables 1 and 2 which will be described later.

Reference numeral 5 denotes the light deflector (polygonal mirror) serving as the deflecting unit, which has a five-sided configuration with a radius of circumcircle of 17 mm.

The light deflector (polygonal mirror) 5 is rotated by a motor 9 at a constant speed in a direction indicated by arrow A in FIGS. 2A and 2B, so that light beams scan the photosensitive drum surfaces 8A and 8B (the surfaces to be scanned) in a direction indicated by arrow B.

The two imaging optical systems SA and SB have like configurations, and hence, to avoid redundant description, the imaging optical system SA is hereinafter mainly described.

The imaging optical system SA forms an image in a spot-like form with a light beam Ra, which is deflected for scanning by the light deflector 5 onto the photosensitive drum surface 8A serving as the surface to be scanned within the main-scanning cross section (in the main-scanning direction) in accordance with image information.

Also, to correct surface tilting, the deflecting surface 5*a* of the light deflector 5 and the photosensitive drum surface 8A are optically conjugated within the sub-scanning cross section.

Normally, when a light deflector has a polygonal mirror with a plurality of deflecting surfaces, tilt angles of the deflecting surfaces in the sub-scanning direction may be varied. Thus, a surface-tilting correction optical system is typically employed.

In this embodiment, the semiconductor laser 1A emits divergent light beams, the coupling lens 2A converts the divergent light beams into slightly divergent light beams, the aperture stop 3A restricts the light beams (light power), and then, the light beams are incident on the cylindrical lens 4A.

Slightly divergent light beams within the main-scanning cross section from among the slightly divergent light beams incident on the cylindrical lens 4A are directly exited from the cylindrical lens 4A without being changed and are incident on the deflecting surface 5*a* of the light deflector 5.

At this time, the light beams incident on the deflecting surface 5*a* are incident such that an angle α defined by the optical axis of the imaging lens 6A and the principal ray of the light beams meets α=70°.

In this embodiment, Conditional expression (3) is satisfied as follows:

$$1.0<|\beta s|<2.2 \quad (3)$$

where βs is an imaging magnification within the sub-scanning cross sections of the plurality of imaging optical systems.

Conditional expression (3) defines the imaging magnification βs within the sub-scanning cross section of the imaging optical system.

If the value is above the upper limit of Conditional expression (3), pitch variation is increased and correction of wavefront aberration becomes insufficient as a result of surface tilting.

If the value is below the lower limit of Conditional expression (3), the imaging lens located close to the surface to be scanned excessively approaches the surface to be scanned. Hence, the length of the imaging lens in the main-scanning direction is increased, and the freedom of arrangement is restricted, which are not desirable.

In this embodiment, the imaging magnification βs of the imaging optical system SA is as follows:

$$\beta s=-1.98$$

The imaging magnification βs of the imaging optical system SB is as follows:

$$\beta s=-1.77$$

These values satisfy Conditional expression (3).

More specifically, Conditional expression (3) may be modified as follows:

$$1.2<|\beta s|<2.0 \quad (3a)$$

Next, Tables 1 and 2 show lens surface shapes and optical arrangements of the optical scanning apparatus according to this embodiment.

TABLE 1

| Configuration of optical scanning apparatus | | |
|---|---|---|
| fθ coefficient, scanning width, field angle | | |
| fθ coefficient | k (mm/rad) | 210.00 |
| Scanning width | W (mm) | 310.00 |
| Maximum field angle | θ max (deg) | 42.29 |
| Wavelength, refractive index | | |
| Use wavelength | λ (nm) | 790.0 |
| Refractive index of coupling lens 2 | N1 | 1.76167 |
| Refractive index of cylindrical lens 4 | N2 | 1.51052 |

TABLE 1-continued

| Configuration of optical scanning apparatus | | |
|---|---|---|
| Refractive index of fθ lens 6 | N3 | 1.52397 |
| Refractive index of fθ lens 7 | N4 | 1.52397 |
| Incident optical system, arrangement | | |
| Incident angle in main-scanning direction | α (deg) | 70.00 |
| Incident angle in sub-scanning direction | γ (deg) | 3.30 |
| Light source 1 to lens incident surface 2a | d0 (mm) | 45.00 |
| Lens incident surface 2a to lens exit surface 2b | d1 (mm) | 2.00 |
| Lens exit surface 2b to aperture stop 3 | d2 (mm) | 5.00 |
| Aperture stop 3 to lens incident surface 4a | d3 (mm) | 5.00 |
| Lens incident surface 4a to lens exit surface 4b | d4 (mm) | 5.00 |
| Lens exit surface 4b to deflection reference point C0 | d5 (mm) | 108.00 |
| Shape of aperture stop | | ellipsoid |
| Aperture stop diameter in main-scanning direction | eay (mm) | 4.60 |
| Aperture stop diameter in sub-scanning direction | eaz (mm) | 3.96 |
| Light deflector | | |
| Number of surfaces of polygon | | 5 |
| Radius of circumcircle | Rpol (mm) | 17 |
| Rotation center to deflection reference point C0 (X direction) | Xpol (mm) | 11.945 |
| Rotation center to deflection reference point C0 (Y direction) | Ypol (mm) | 6.918 |
| Scanning optical system, arrangement | | |
| Deflection reference point C0 to lens incident surface 6a | L0 (mm) | 27.70 |
| Lens incident surface 6a to | L1 (mm) | 9.00 |

TABLE 1-continued

| Configuration of optical scanning apparatus | | |
|---|---|---|
| lens exit surface 6b | | |
| Lens exit surface 6b to lens incident surface 7a | L2 (mm) | 75.20 |
| Lens incident surface 7a to lens exit surface 7b | L3 (mm) | 5.00 |
| Lens exit surface 7b to surface to be scanned 8 | L4 (mm) | 129.10 |
| Polygonal deflecting surface 5a to surface to be scanned 8 | L total | 246.00 |
| Sub-scanning decentration of lens 7 | shiftZ (mm) | 1.581 |
| Inclination decentration of lens 7 | RotZ (minute) | 0.544 |

| Shape of coupling lens 2 | | |
|---|---|---|
| | Incident surface 2a | Exit surface 2b |
| R | ∞ | −35.14 |

| Meridional shape of cylindrical lens 4 | | | Sagital shape of cylindrical lens 4 | | |
|---|---|---|---|---|---|
| | Incident surface 4a | Exit surface 4b | | Incident surface 4a | Exit surface 4b |
| R | ∞ | ∞ | Rs | 56.5 | ∞ |

| Meridional shape of fθ lens 6 | | | Sagital shape of fθ lens 6 | | |
|---|---|---|---|---|---|
| | Incident surface 6a Not light source side | Exit surface 6b Not light source side | | Incident surface 6a Not light source side | Exit surface 6b Not light source side |
| R | −7.26244E+01 | −4.30596E+01 | Rs | 5.00000E+02 | −3.27935E+01 |
| Ke | 2.91659E+00 | −2.17420E−01 | D2e | 0.00000E+00 | 8.56647E−05 |
| B4e | −7.83532E−07 | −5.04281E−07 | D4e | 0.00000E+00 | 2.82218E−08 |
| B6e | 8.09180E−09 | 1.99884E−09 | D6e | 0.00000E+00 | −1.68952E−11 |
| B8e | −9.23423E−12 | 6.03260E−13 | D8e | 0.00000E+00 | 0.00000E+00 |
| B10e | 3.31468E−15 | −2.03097E−15 | D10e | 0.00000E+00 | 0.00000E+00 |
| | Light source side | Light source side | | Light source side | Light source side |
| R | −7.26244E+01 | −4.30596E+01 | Rs | 5.00000E+02 | −3.27935E+01 |
| Ks | 2.91659E+00 | −2.17420E−01 | D2s | 0.00000E+00 | 2.57239E−05 |
| B4s | −7.83532E−07 | −5.04281E−07 | D4s | 0.00000E+00 | 3.87663E−08 |
| B6s | 8.09180E−09 | 1.99884E−09 | D6s | 0.00000E+00 | −1.07545E−11 |
| B8s | −9.23423E−12 | 6.03260E−13 | D8s | 0.00000E+00 | 0.00000E+00 |
| B10s | 3.31468E−15 | −2.03097E−15 | D10s | 0.00000E+00 | 0.00000E+00 |

| Meridional shape of fθ lens 7 | | | Sagital shape of fθ lens 7 | | |
|---|---|---|---|---|---|
| | Incident surface 7a Not light source side | Exit surface 7b Not light source side | | Incident surface 7a Not light source side | Exit surface 7b Not light source side |
| R | −1.20289E+04 | 4.77512E+02 | Rs | 2.67651E+02 | −4.33509E+01 |
| Ke | 0.00000E+00 | −1.16468E+02 | D2e | −4.78914E−05 | 1.00421E−04 |
| B4e | 0.00000E+00 | −1.72972E−07 | D4e | −1.56436E−08 | −1.86020E−08 |
| B6e | 0.00000E+00 | 1.28348E−11 | D6e | 1.37062E−12 | 6.01693E−12 |

TABLE 1-continued

| Configuration of optical scanning apparatus | | | | | |
|---|---|---|---|---|---|
| B8e | 0.00000E+00 | −6.58473E−16 | D8e | −5.36075E−17 | −8.59144E−16 |
| B10e | 0.00000E+00 | 1.50313E−20 | D10e | 7.53315E−21 | 7.66171E−20 |
| | Light source side | Light source side | | Light source side | Light source side |
| R | −1.20289E+04 | 4.77512E+02 | Rs | 2.67651E+02 | −4.33509E+01 |
| Ks | 0.00000E+00 | −1.16468E+02 | D2s | −4.78914E−05 | 7.54387E−05 |
| B4s | 0.00000E+00 | −1.72972E−07 | D4s | −1.56436E−08 | −8.55953E−10 |
| B6s | 0.00000E+00 | 1.28348E−11 | D6s | 1.37062E−12 | −7.09768E−13 |
| B8s | 0.00000E+00 | −6.58473E−16 | D8s | −5.36075E−17 | 2.60979E−16 |
| B10s | 0.00000E+00 | 1.50313E−20 | D10s | 7.53315E−21 | 6.63885E−21 |

TABLE 2

| Configuration of optical scanning apparatus | | |
|---|---|---|
| fθ coefficient, scanning width, field angle | | |
| fθ coefficient | k (mm/rad) | 199.1614 |
| Scanning width | W (mm) | 310.00 |
| Maximum field angle | θ max (deg) | 44.59 |
| Wavelength, refractive index | | |
| Use wavelength | λ (nm) | 790.0 |
| Refractive index of coupling lens 2 | N1 | 1.76167 |
| Refractive index of cylindrical lens 4 | N2 | 1.51052 |
| Refractive index of fθ lens 6 | N3 | 1.52397 |
| Refractive index of fθ lens 7 | N4 | 1.52397 |
| Incident optical system, arrangement | | |
| Incident angle in main-scanning direction | α (deg) | 70.00 |
| Incident angle in sub-scanning direction | γ (deg) | 3.30 |
| Light source 1 to lens incident surface 2a | d0 (mm) | 45.81 |
| Lens incident surface 2a to lens exit surface 2b | d1 (mm) | 2.00 |
| Lens exit surface 2b to aperture stop 3 | d2 (mm) | 4.19 |
| Aperture stop 3 to lens incident surface 4a | d3 (mm) | 9.40 |
| Lens incident surface 4a to lens exit surface 4b | d4 (mm) | 5.00 |
| Lens exit surface 4b to deflection | d5 (mm) | 103.60 |

TABLE 2-continued

| Configuration of optical scanning apparatus | | |
|---|---|---|
| reference point C0 | | |
| Shape of aperture stop | | ellipsoid |
| Aperture stop diameter in main-scanning direction | eay (mm) | 4.60 |
| Aperture stop diameter in sub-scanning direction | eaz (mm) | 3.44 |
| Light deflector | | |
| Number of surfaces of polygon | | 5 |
| Radius of circumcircle | Rpol (mm) | 17 |
| Rotation center to deflection reference point C0 (X direction) | Xpol (mm) | 11.945 |
| Rotation center to deflection reference point C0 (Y direction) | Ypol (mm) | 6.918 |
| Scanning optical system, arrangement | | |
| Deflection reference point C0 to lens incident surface 6a | L0 (mm) | 27.70 |
| Lens incident surface 6a to lens exit surface 6b | L1 (mm) | 9.00 |
| Lens exit surface 6b to lens incident surface 7a | L2 (mm) | 75.20 |
| Lens incident surface 7a to lens exit surface 7b | L3 (mm) | 5.00 |
| Lens exit surface 7b to surface to be scanned 8 | L4 (mm) | 115.00 |
| Polygonal deflecting surface 5a to surface to be scanned 8 | L total | 231.90 |
| Sub-scanning decentration of lens 7 | shiftZ (mm) | −1.730 |
| Inclination decentration of lens 7 | RotZ (minute) | 0.560 |

TABLE 2-continued

| Configuration of optical scanning apparatus | | | | | |
|---|---|---|---|---|---|
| Shape of coupling lens 2 | | | | | |
| | Incident surface 2a | Exit surface 2b | | | |
| R | ∞ | −35.14 | | | |
| Meridional shape of cylindrical lens 4 | | | Sagital shape of cylindrical lens 4 | | |
| | Incident surface 4a | Exit surface 4b | | Incident surface 4a | Exit surface 4b |
| R | ∞ | ∞ | Rs | 56.5 | ∞ |
| Meridional shape of fθ lens 6 | | | Sagital shape of fθ lens 6 | | |
| | Incident surface 6a Not light source side | Exit surface 6b Not light source side | | Incident surface 6a Not light source side | Exit surface 6b Not light source side |
| R | −7.26244E+01 | −4.30596E+01 | Rs | 5.00000E+02 | −3.27935E+01 |
| Ke | 2.91659E+00 | −2.17420E−01 | D2e | 0.00000E+00 | 8.56647E−05 |
| B4e | −7.83532E−07 | −5.04281E−07 | D4e | 0.00000E+00 | 2.82218E−08 |
| B6e | 8.09180E−09 | 1.99884E−09 | D6e | 0.00000E+00 | −1.68952E−11 |
| B8e | −9.23423E−12 | 6.03260E−13 | D8e | 0.00000E+00 | 0.00000E+00 |
| B10e | 3.31468E−15 | −2.03097E−15 | D10e | 0.00000E+00 | 0.00000E+00 |
| | Light source side | Light source side | | Light source side | Light source side |
| R | −7.26244E+01 | −4.30596E+01 | Rs | 5.00000E+02 | −3.27935E+01 |
| Ks | 2.91659E+00 | −2.17420E−01 | D2s | 0.00000E+00 | 2.57239E−05 |
| B4s | −7.83532E−07 | −5.04281E−07 | D4s | 0.00000E+00 | 3.87663E−08 |
| B6s | 8.09180E−09 | 1.99884E−09 | D6s | 0.00000E+00 | −1.07545E−11 |
| B8s | −9.23423E−12 | 6.03260E−13 | D8s | 0.00000E+00 | 0.00000E+00 |
| B10s | 3.31468E−15 | −2.03097E−15 | D10s | 0.00000E+00 | 0.00000E+00 |
| Meridional shape of fθ lens 7 | | | Sagital shape of fθ lens 7 | | |
| | Incident surface 7a Not light source side | Exit surface 7b Not light source side | | Incident surface 7a Not light source side | Exit surface 7b Not light source side |
| R | −6.14041E+03 | 4.35377E+02 | Rs | 1.92200E+02 | −4.26456E+01 |
| Ke | 0.00000E+00 | −1.17557E+02 | D2e | −4.15733E−05 | 1.07317E−04 |
| B4e | 0.00000E+00 | −1.64651E−07 | D4e | −9.90033E−09 | −2.09415E−08 |
| B6e | 0.00000E+00 | 9.88258E−12 | D6e | 4.87746E−13 | 7.07204E−12 |
| B8e | 0.00000E+00 | −3.66545E−16 | D8e | 5.14676E−19 | −1.07214E−15 |
| B10e | 0.00000E+00 | 3.95393E−21 | D10e | 3.36649E−21 | 8.85221E−20 |
| | Light source side | Light source side | | Light source side | Light source side |
| R | −6.14041E+03 | 4.35377E+02 | Rs | 1.92200E+02 | −4.26456E+01 |
| Ks | 0.00000E+00 | −1.17557E+02 | D2s | −4.15733E−05 | 8.27386E−05 |
| B4s | 0.00000E+00 | −1.64651E−07 | D4s | −9.90033E−09 | −4.60811E−09 |
| B6s | 0.00000E+00 | 9.88258E−12 | D6s | 4.87746E−13 | 1.23427E−12 |
| B8s | 0.00000E+00 | −3.66545E−16 | D8s | 5.14676E−19 | −1.59217E−16 |
| B10s | 0.00000E+00 | 3.95393E−21 | D10s | 3.36649E−21 | 3.45300E−20 |

Herein, Table 1 shows lens shapes and arrangement of the imaging optical system SA, and Table 2 shows lens shapes and arrangement of the imaging optical system SB.

Meridional shapes of lens incident surfaces and lens exit surfaces of the imaging lenses 6A, 7A, and 7B are aspherical surfaces which may be expressed by a function of tenth or lower order.

When origins are respective intersections of the lens surfaces of the imaging lenses 6A, 7A, and 7B serving as imaging optical elements and optical axes of the imaging lenses 6A, 7A, and 7B, the X axis is the optical-axis direction, and the Y axis is an axis orthogonal to the optical axis within the main-scanning cross section, a meridional direction corresponding to the main-scanning direction is expressed as follows:

$$X = \frac{Y^2/R}{1+(1-(1+K)(Y/R)^2)^{1/2}} + B_4Y^4 + B_6Y^6 + B_8Y^8 + B_{10}Y^{10} \quad \text{Expression 1}$$

where R is a curvature radius n the meridional direction, and K, $B_4$, $B_6$, $B_8$, and $B_{10}$ are aspherical coefficients.

From among the aspherical coefficients $B_4$, $B_6$, $B_8$, and $B_{10}$, aspherical coefficients $B_{4s}$, $B_{6s}$, $B_{8s}$, and $B_{10s}$ on the side provided with the semiconductor laser 1A of the optical scanning apparatus are different from aspherical coefficients $B_{4e}$, $B_{6e}$, $B_{8e}$, and $B_{10e}$ on the side not provided with the semiconductor laser 1A.

As a result, asymmetric shapes in the main-scanning direction can be expressed.

Also, a sagittal direction corresponding to the sub-scanning direction is expressed as follows:

$$S = \frac{\frac{Z^2}{Rs^*}}{1+\sqrt{1-\left(\frac{Z}{Rs^*}\right)^2}} \qquad \text{Expression 2}$$

where S is a sagittal shape including a normal of meridional at a position in the meridional direction and defined within a plane perpendicular to a main-scanning plane.

Herein, a curvature radius (curvature radius in the sagittal direction) Rs* in the sub-scanning direction at a position apart from the optical axis in the main-scanning direction by Y is expressed as follows:

$$Rs^*=Rs\times(1+D2\times Y^2+D4\times Y^{4+}D6\times Y^6+D8\times Y^8+D10\times Y^{10}) \qquad \text{Expression 3}$$

where Rs is a curvature radius in the sagittal direction on the optical axis, and $D_2$, $D_4$, $D_6$, $D_8$, and $D_{10}$ are sagittal change coefficients.

Similarly to the main-scanning shapes, from among the aspherical coefficients $D_2$ to $D_{10}$, aspherical coefficients $D_{2s}$ to $D_{10s}$ on the side provided with the semiconductor laser 1A of the optical scanning apparatus are different from aspherical coefficients $D_{2e}$ to $D_{10e}$ on the side not provided with the semiconductor laser 1A. As a result, asymmetric shapes in the main-scanning direction can be expressed.

In this embodiment, while the functions of the surface shapes are defined by the above-mentioned expressions, the scope of the present invention is not limited thereto.

Figure 5A:
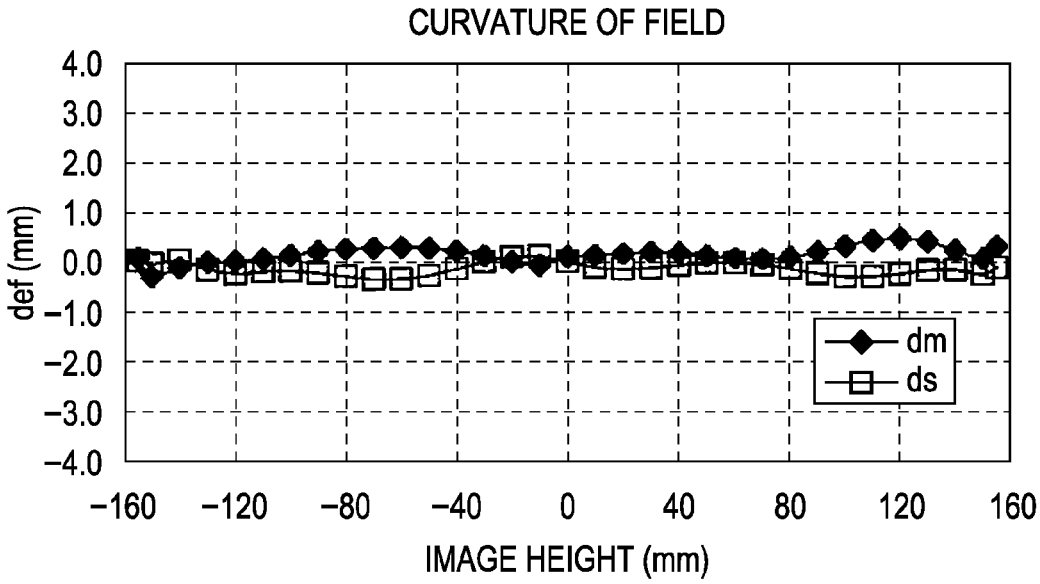
FIG. 5A is a graph showing a curvature of field according to the first embodiment of the present invention.
Figure 5B:
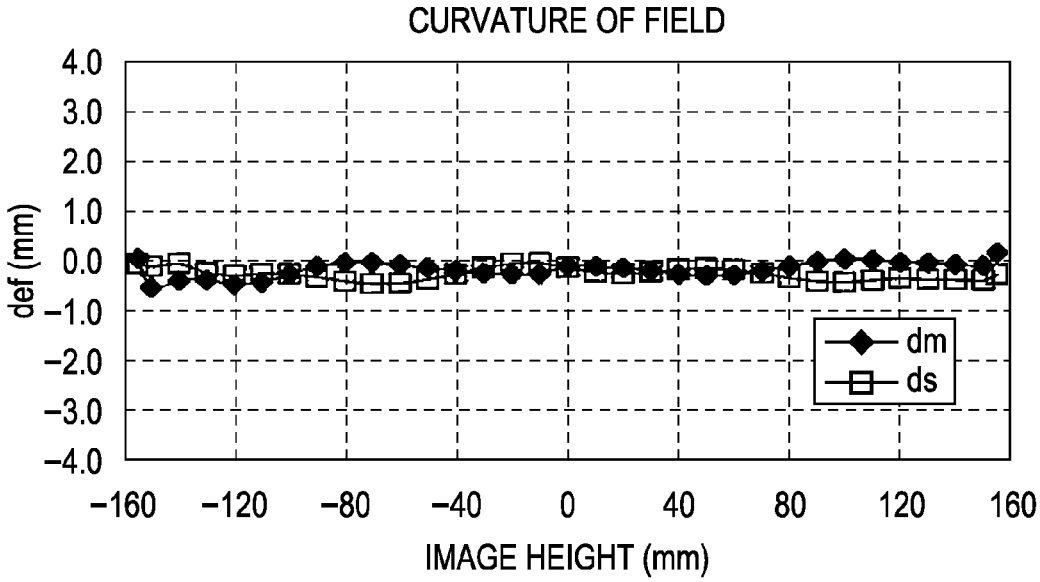
FIG. 5B is a graph showing a curvature of field according to the first embodiment of the present invention.

FIGS. 5A and 5B are graphs showing curvatures of field in the main-scanning direction and the sub-scanning direction according to the first embodiment of the present invention.

FIGS. 5A, 6A, 7A, 8A, and 9A exhibit optical performances of the imaging optical system SA for the light beam Ra, whereas FIGS. 5B, 6B, 7B, 8B, and 9B exhibit optical performances of the imaging optical system SB for the light beam Rb.

In the imaging optical system SA, a curvature of field dm in the main-scanning direction is 0.72 mm, and a curvature of field ds in the sub-scanning direction is 0.46 mm in an effective width of an image (W=310 mm).

In the imaging optical system SB, a curvature of field dm in the main-scanning direction is 0.74 mm, and a curvature of field ds in the sub-scanning direction is 0.42 mm. Thus, it is found that both the curvatures of field are corrected.

Figure 6A:
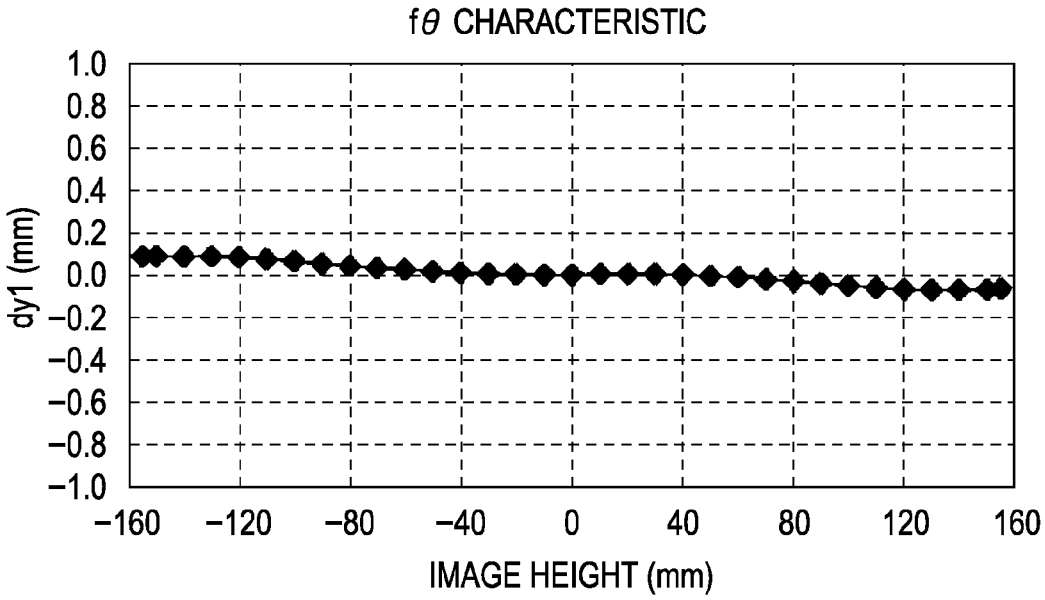
FIG. 6A is a graph showing an imaging position deviation in a main-scanning direction according to the first embodiment of the present invention.
Figure 6B:
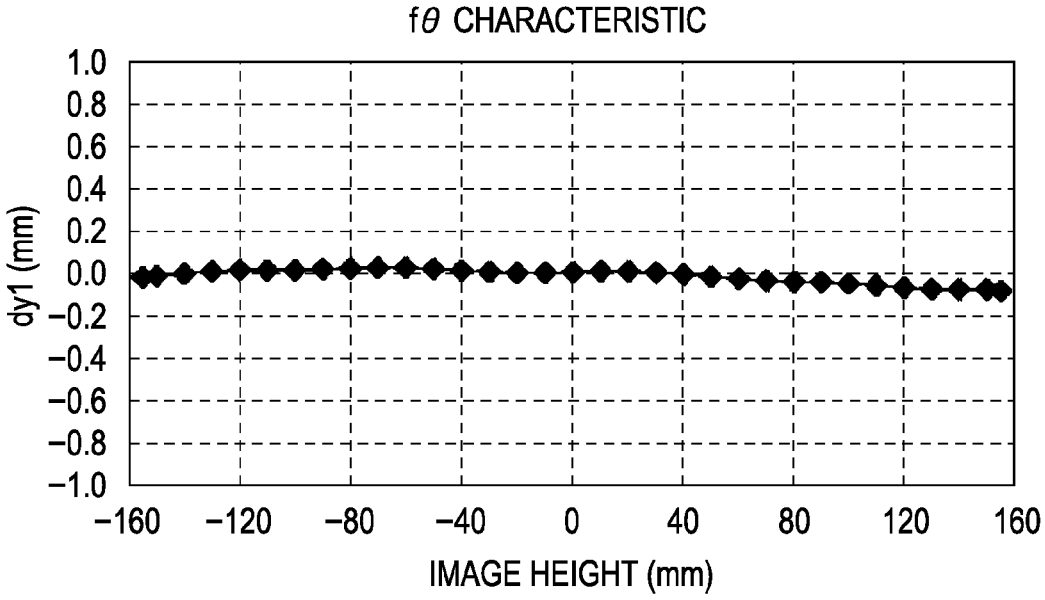
FIG. 6B is a graph showing an imaging position deviation in the main-scanning direction according to the first embodiment of the present invention.

FIGS. 6A and 6B are graphs showing fθ characteristics dy1 according to the first embodiment of the present invention.

The fθ characteristics dy1 is a difference obtained when an ideal image height is subtracted from a position where the light beam actually reaches.

The imaging optical system SA causes a shift of 85 μm at maximum, and the imaging optical system SB causes a shift of 90 μm at maximum.

If the imaging optical systems SA and SB are used without the shifts being corrected, the shifts may cause color misregistration to occur in the main-scanning direction.

Owing to this, to reduce the fθ characteristic dy1, it is desirable to change an image clock in accordance with each image height.

The insufficiency of correction of the fθ characteristic can be electrically corrected by changing the image clock. However, if the shift of the fθ characteristic becomes too large, the spot diameter in the main-scanning direction would be changed.

In this embodiment, the shift of the fθ characteristic to be generated would not cause the spot diameter to be markedly changed. Hence, even when a latent image is formed onto a photosensitive drum with the optical scanning apparatus of this embodiment, the shift would not cause color-density unevenness of an image to occur.

Figure 7A:
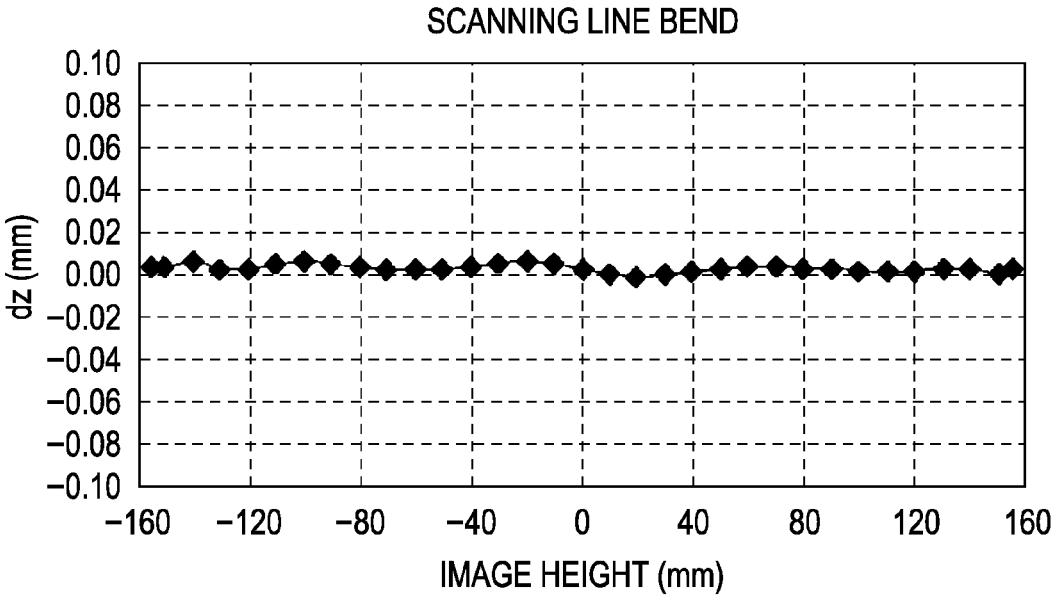
FIG. 7A is a graph showing a scanning line bend according to the first embodiment of the present invention.
Figure 7B:
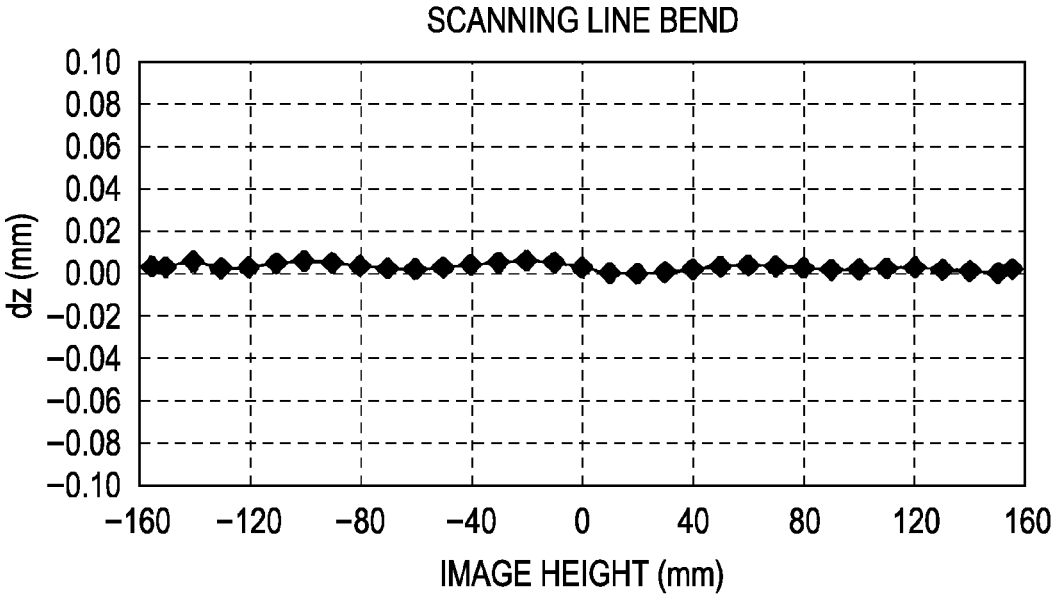
FIG. 7B is a graph showing a scanning line bend according to the first embodiment of the present invention.

FIGS. 7A and 7B are graphs each showing a scanning line bend dz according to the first embodiment of the present invention.

A scanning line bend dz is expressed by a difference obtained when an imaging position in the sub-scanning direction at the center of an image is subtracted from an imaging position in the sub-scanning direction at each image height.

The imaging optical system SA causes a shift of 7 μm at maximum, and the imaging optical system SB causes a shift of 6 μm at maximum.

Both the shifts are easy to ignore in images.

In this embodiment, the imaging lens 7A is rotated clockwise around the optical axis as a rotation axis by 0.544 minutes when seen from the light deflector 5.

Also, the imaging lens 7B is rotated counterclockwise around the optical axis as a rotation axis by 0.560 minutes when seen from the light deflector 5. Accordingly, an inclination of a scanning line is corrected.

Figure 8A:
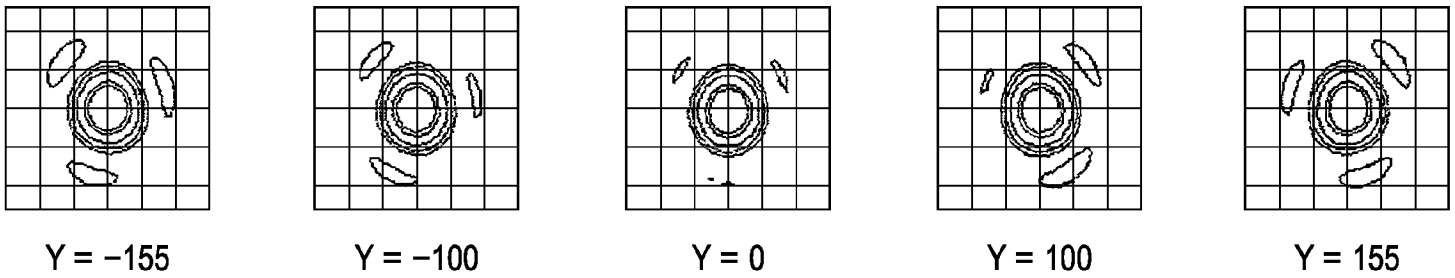
FIG. 8A shows a spot profile according to the first embodiment of the present invention.
Figure 8B:
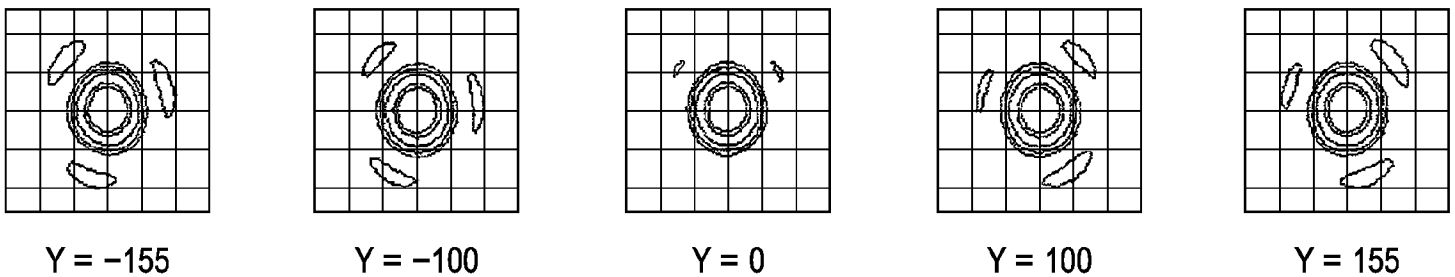
FIG. 8B shows a spot profile according to the first embodiment of the present invention.

FIGS. 8A and 8B are explanatory illustrations each showing cross sections of spots at respective image heights.

FIGS. 8A and 8B illustrate cross sections sliced with 2%, 5%, 10%, 13.5%, 36.8%, and 50% of the peak light power at a spot of an image height.

Normally, with the optical scanning apparatus in which a light beam is obliquely incident within the sub-scanning cross section, a spot may be deformed as a result of torsion of wavefront aberration.

In this embodiment, the torsion of wavefront aberration is reduced by optimizing power arrangement of respective surfaces, and tilt and shift amounts of a lens.

In the imaging optical system SA, to correct the wavefront aberration, the imaging lens 7A is shifted in the sub-scanning direction by 1.58 mm with respect to the plane P0.

In the imaging optical system SB, to correct the wavefront aberration, the imaging lens 7B is shifted in the sub-scanning direction by 1.73 mm with respect to the plane P0.

Accordingly, the complete spot profile without deformation can be provided at any image height.

Figure 9A:
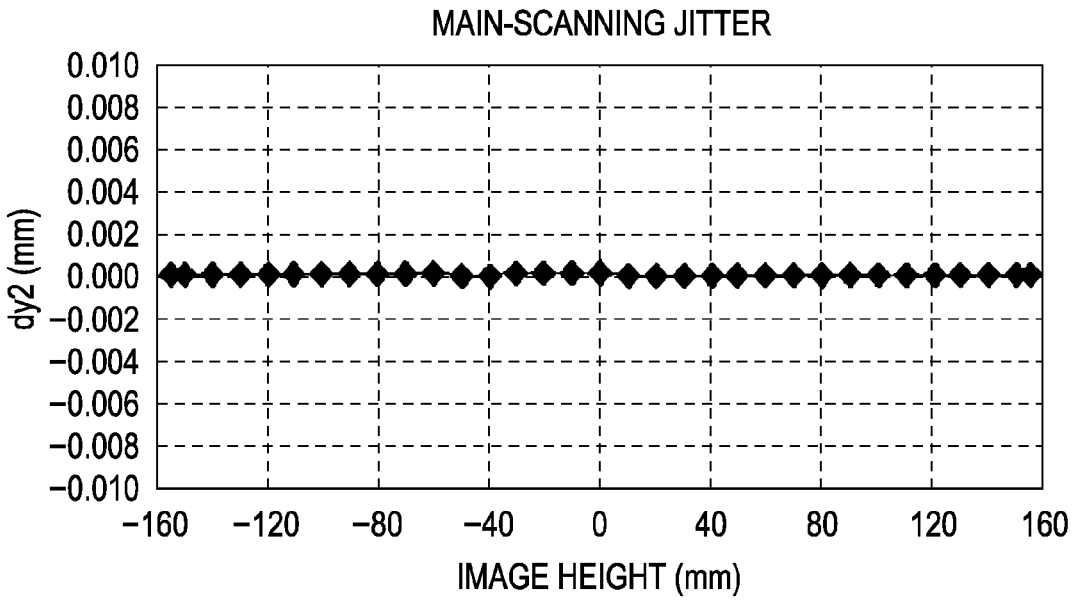
FIG. 9A is a graph showing a jitter in the main-scanning direction according to the first embodiment of the present invention.
Figure 9B:
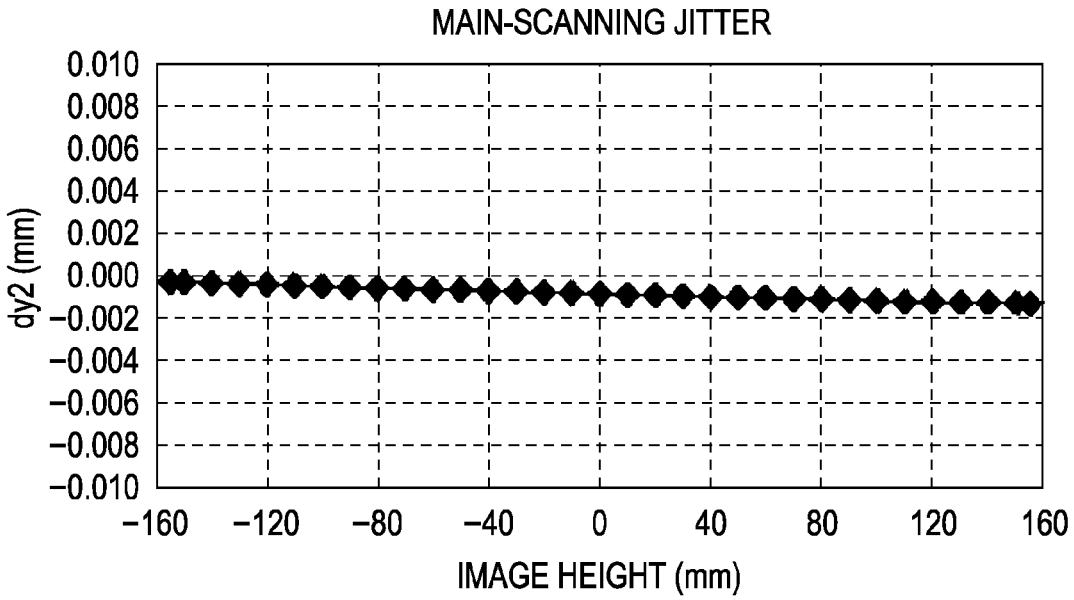
FIG. 9B is a graph showing a jitter in the main-scanning direction according to the first embodiment of the present invention.

FIGS. 9A and 9B are explanatory illustrations each showing a jitter dy2 in the main-scanning direction when a deflective reflection surface has a shift decentration error of 10 μm.

The imaging optical system SA has a jitter in the main-scanning direction of 0.1 μm at maximum, and the imaging optical system SB has a jitter of 1.4 μm at maximum. Thus, the jitters can be restricted and easily ignored.

Meanwhile, in recent years, development of a resonant light deflector, in which a single deflecting surface is vibrated in a reciprocation manner, has been promoted.

With the resonant light deflector, pitch variation as a result of surface tilting, a jitter in the main-scanning direction as a result of surface decentration, etc., can be overcome.

Accordingly, when this embodiment is used in combination with the resonant light deflector, the advantage of this embodiment can be further enhanced.

As described above, in a related art example, a common optical system is used for two scanning light beams. In contrast, in this embodiment, a part of an imaging optical system for a light beam is different from that for another light beam, so as to provide scanning with different Kθ coefficients.

Accordingly, the freedom of arrangement of optical paths is enhanced, and optical components may be minimal components.

Also, since parameters such as the Kθ coefficient and the convergence m are defined, an optical system can be provided which is practical without a disadvantage in optical performance.

Also, while the obliquely incident optical system in which a light beam is obliquely incident on the deflecting surface of the light deflector within the sub-scanning cross section is described in this embodiment, it is not limited thereto.

For example, an optical system in which polygonal mirrors are provided at two vertically arranged positions and a light beam is perpendicularly incident on each of deflecting surfaces of the polygonal mirror within the sub-scanning cross section provides another embodiment of the present invention with similar advantages over prior art.

While the imaging optical system includes the plurality of imaging lenses, it is not limited thereto. The imaging optical system may include a plurality of imaging lenses or a single image lens.

In such a case, the imaging lenses 6A and 6'A located closest to the light deflector 5 are used.

Second Embodiment

Figure 10A:
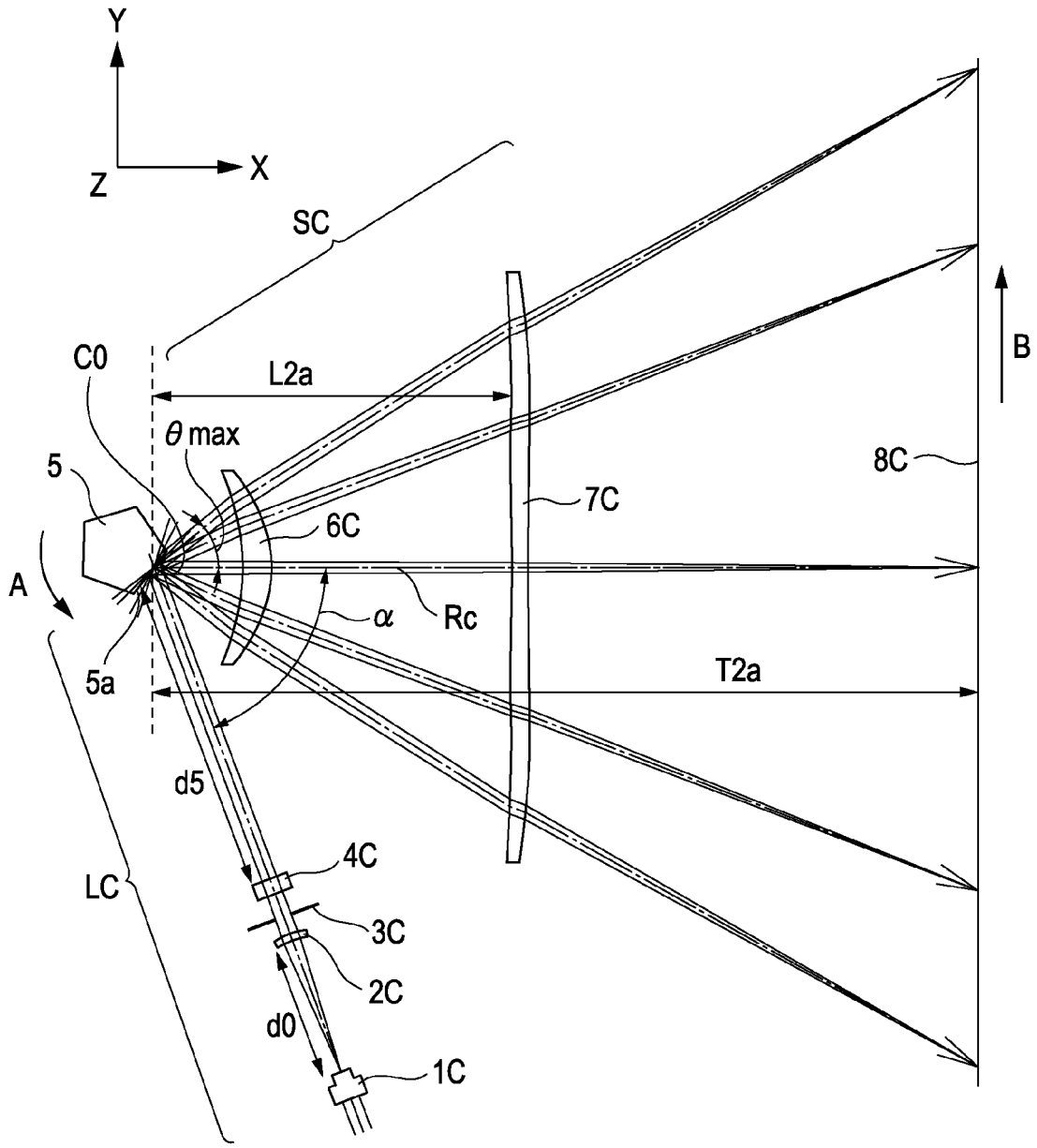
FIG. 10A illustrates a main-scanning cross section of an optical scanning apparatus according to a second embodiment of the present invention.
Figure 10B:
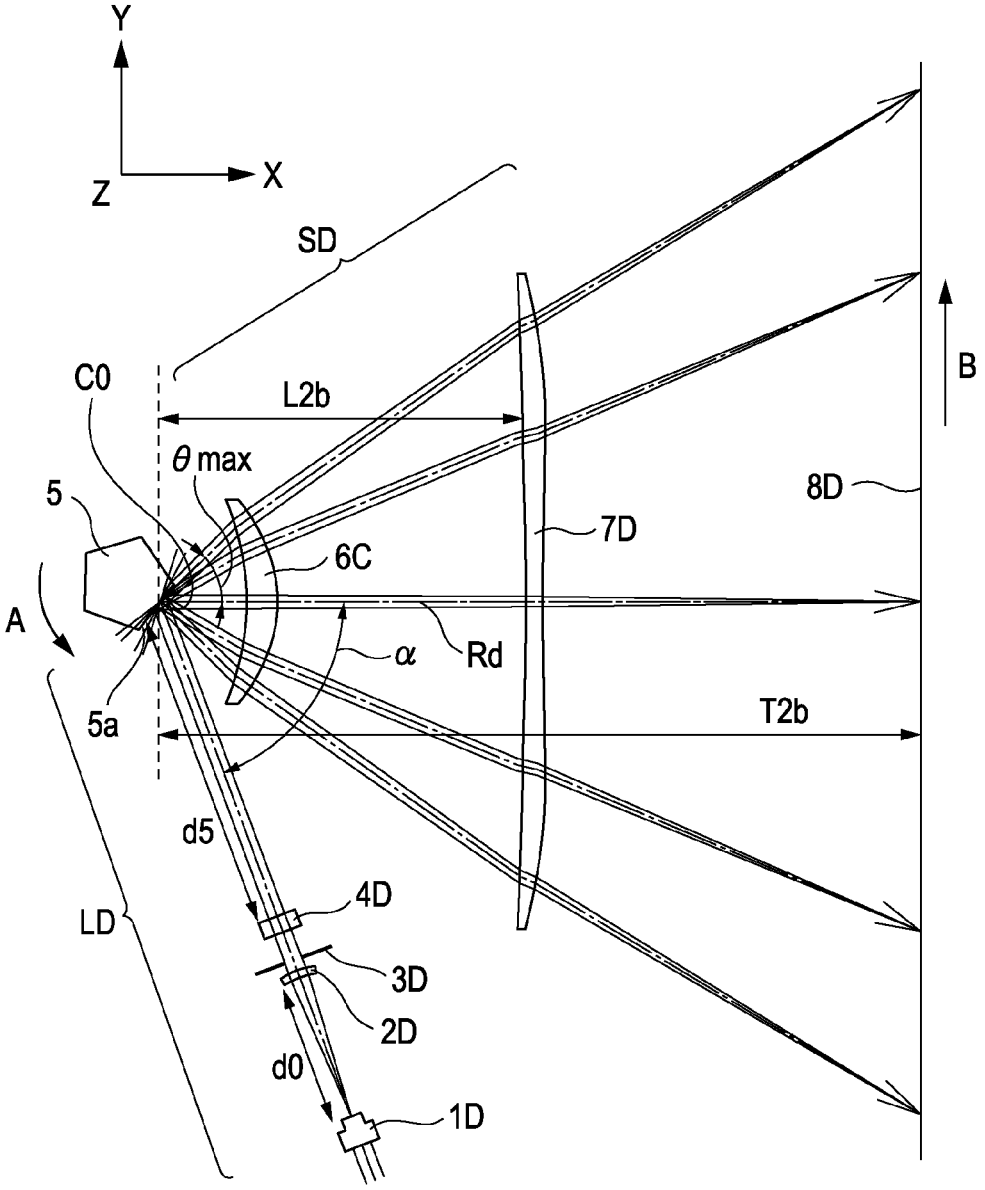
FIG. 10B illustrates a main-scanning cross section of the optical scanning apparatus according to the second embodiment of the present invention.

FIGS. 10A and 10B each are a cross section of a primary portion in a main-scanning direction (main-scanning cross sections) according to a second embodiment of the present invention.

FIG. 10A illustrates a main-scanning cross section of an imaging optical system SC for a light beam Rc from among light beams Rc and Rd to be deflected for scanning to the same side by a light deflector 5. FIG. 10B illustrates a main-scanning cross section of an imaging optical system SD for the light beam Rd.

In FIGS. 10A and 10B, like reference numerals refer like components as in FIGS. 2A and 2B.

The sub-scanning cross section is similar to that shown in FIG. 1 according to the above-described first embodiment.

This embodiment is different from the first embodiment in that the freedom of arrangement of optical components is further enhanced by increasing a difference between optical path lengths of the two imaging optical systems SC and SD.

Other configurations and optical effects are similar to those of the first embodiment. Thus, similar advantages can be obtained.

Configurations of the imaging optical systems SC and SD are similar to those of the imaging optical systems SA and SB of the first embodiment.

Herein, when reference character T2*a* denotes the optical path length of the imaging optical system SC in FIG. 10A, and T2*b* denotes the optical path length of the imaging optical system SD in FIG. 10B, the optical path lengths are determined as follows:

$$T2a=257.47 \text{ mm}$$

$$T2b=232.0 \text{ mm}$$

Thus, the difference between these optical path lengths is 25.47 mm.

To obtain such a difference between the optical path lengths, the above-mentioned Kθ coefficient K and convergence m in the imaging optical system SC may be different from those in the imaging optical system SD.

In this embodiment, when reference character Kc denotes a Kθ coefficient and mc denotes a convergence of the imaging optical system SC for the light beam Rc, and when Kd denotes a Kθ coefficient and md denotes a convergence of the imaging optical system SD for the light beam Rd, respective parameters are determined as follows:

$$Kc=220.0 \text{ (mm/rad)}, mc=-0.061$$

$$Kd=200.0 \text{ (mm/rad)}, md=0.077$$

Thus, when reference character $K_1$ denotes a Kθ coefficient of the imaging optical system SD with the short optical path length, and $K_2$ denotes a Kθ coefficient of the imaging optical system SC with the long optical path length, these are expressed as follows:

$$K_1/K_2=Kd/Kc=0.9091$$

This satisfies Conditional expression (1).

Also, both the convergence mc of the imaging optical system SC with the long optical path length, and the convergence and of the imaging optical system SD with the short optical path length satisfy Conditional expression (2).

Figure 11:
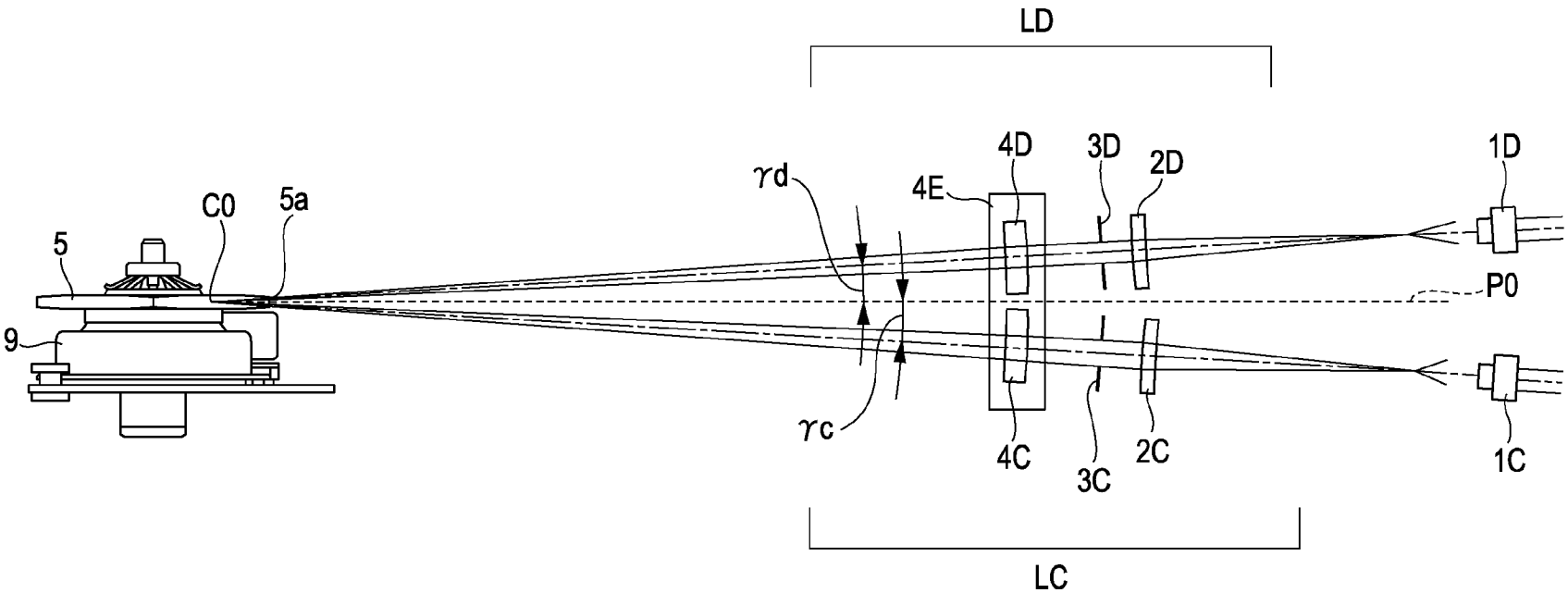
FIG. 11 illustrates a sub-scanning cross section of an incident optical system of the optical scanning apparatus according to the second embodiment of the present invention.

FIG. 11 is a sub-scanning cross section of each of the incident optical systems defining the scanning unit SR.

In the drawing, like reference numerals refer like components as in FIG. 4.

In this embodiment, when reference character P0 denotes a plane perpendicular to the deflecting surface 5*a* of the light deflector 5 and passing through the reference point C0, light beams having obliquely incident angles of γa=3.3° and γb=3.3° with respect to the plane P0 are deflected for scanning.

If the obliquely incident angles are too large, it is difficult to correct deformation of a spot as a result of torsion of wavefront aberration. If the obliquely incident angles are too small, it is difficult to separate an optical path.

In this embodiment, since the vertically adjacent obliquely incident angles γa and γb are both 3.3°, the optical path is easily separated by the reflection mirror M2.

In this embodiment, the light sources employ semiconductor lasers 1C and 1D. The semiconductor lasers 1C and 1D emit divergent light beams. The coupling lens 2C converts the divergent light beams into slightly divergent light beams (m=−0.061).

Also, the coupling lens 2D converts the divergent light beams into slightly convergent light beams (m=0.077).

The cylindrical lenses 4C and 4D temporarily form images with light beams condensed by the coupling lenses 2C and 2D onto the deflecting surfaces 5*a* of the light deflector 5.

The aperture stops 3C and 3D have different diameters in the sub-scanning direction so as to provide equivalent spot diameters ($1/e^2$ slice diameters of peak light powers of spots) onto the photosensitive drum surfaces 8C and 8D (the surfaces to be scanned).

In this embodiment, curvature radii of the cylindrical lenses 4C and 4D are varied (shapes are varied) in the sub-scanning direction, and hence, distances d5 from the cylindrical lenses 4C and 4D to the deflecting surface are equivalent.

Accordingly, the vertically arranged cylindrical lenses are integrally formed by a plastic lens 4E to reduce the number of components, thereby simplifying the entire apparatus.

The coupling lens 2C and the cylindrical lens 4C may be integrally formed as a single optical element (anamorphic lens).

Accordingly, two coupling lenses and two cylindrical lenses can be formed by an integrated anamorphic plastic lens.

The two imaging optical systems SC and SD have similar configurations, and hence, to avoid redundant description, the imaging optical system SC is hereinafter mainly described.

The imaging optical system SC forms an image, as a spot with a light beam Rc deflected for scanning by the light deflector 5, onto the photosensitive drum surface 8C serving as the surface to be scanned within the main-scanning cross section (in the main-scanning direction) in accordance with image information.

Also, to correct surface tilting, the deflecting surface 5*a* of the light deflector 5 and the photosensitive drum surface 8C are optically conjugated within the sub-scanning cross section.

Normally, when a light deflector has a polygonal mirror or the like with a plurality of deflecting surfaces, tilt angles of the deflecting surfaces in the sub-scanning direction may be varied. Thus, a surface-tilting correction optical system is typically employed.

In this embodiment, the semiconductor laser 1C emits divergent light beams, the coupling lens 2C converts the divergent light beams into slightly divergent light beams, the aperture stop 3C restricts the light beams (light power), and then, the light beams are incident on the cylindrical lens 4C.

Parallel light beams within the main-scanning cross section from among the parallel light beams incident on the cylindrical lens 4C are directly exited from the cylindrical lens 4C without being changed and are incident on the deflecting surface 5*a* of the light deflector 5.

At this time, the light beams to be incident on the deflecting surface 5*a* are incident such that an angle α defined by the optical axis of the imaging lens 6C and the principal ray of the light beams meets α=70°.

In this embodiment, the imaging magnification βs of the imaging optical system SC is as follows:

$$\beta s=-1.83$$

The imaging magnification βs of the imaging optical system SD is as follows:

$$\beta s=-1.50$$

These values satisfy Conditional expression (3).

Next, Tables 3 and 4 show lens surface shapes and optical arrangements of the optical scanning apparatus according to this embodiment.

The definitional expression of the surface shape uses the same expression as that of the first embodiment.

TABLE 3

| Configuration of optical scanning apparatus | | |
|---|---|---|
| fθ coefficient, scanning width, field angle | | |
| fθ coefficient | k (mm/rad) | 220.00 |
| Scanning width | W (mm) | 310.00 |
| Maximum field angle | θ max (deg) | 40.37 |
| Wavelength, refractive index | | |
| Use wavelength | λ (nm) | 790.0 |
| Refractive index of coupling lens 2 | N1 | 1.76167 |
| Refractive index of cylindrical lens 4 | N2 | 1.52397 |
| Refractive index of fθ lens 6 | N3 | 1.52397 |
| Refractive index of fθ lens 7 | N4 | 1.52397 |
| Incident optical system, arrangement | | |
| Incident angle in main-scanning direction | α (deg) | 70.00 |
| Incident angle in sub-scanning direction | γ (deg) | 3.30 |
| Light source 1 to lens incident surface 2a | d0 (mm) | 44.42 |

TABLE 3-continued

| Configuration of optical scanning apparatus | | |
|---|---|---|
| Lens incident surface 2a to lens exit surface 2b | d1 (mm) | 2.00 |
| Lens exit surface 2b to aperture stop 3 | d2 (mm) | 5.58 |
| Aperture stop 3 to lens incident surface 4a | d3 (mm) | 10.00 |
| Lens incident surface 4a to lens exit surface 4b | d4 (mm) | 3.00 |
| Lens exit surface 4b to deflection reference point C0 | d5 (mm) | 105.00 |
| Shape of aperture stop | | ellipsoid |
| Aperture stop diameter in main-scanning direction | eay (mm) | 4.60 |
| Aperture stop diameter in sub-scanning direction | eaz (mm) | 3.54 |
| Light deflector | | |
| Number of surfaces of polygon | | 5 |
| Radius of circumcircle | Rpol (mm) | 17 |
| Rotation center to deflection reference point C0 (X direction) | Xpol (mm) | 11.945 |
| Rotation center to deflection reference point C0 (Y direction) | Ypol (mm) | 6.918 |
| Scanning optical system, arrangement | | |
| Deflection reference point C0 to lens incident surface 6a | L0 (mm) | 27.70 |
| Lens incident surface 6a to lens exit surface 6b | L1 (mm) | 9.00 |
| Lens exit surface 6b to lens incident surface 7a | L2 (mm) | 75.30 |
| Lens incident surface 7a to lens exit surface 7b | L3 (mm) | 5.00 |
| Lens exit surface 7b to surface to be scanned 8 | L4 (mm) | 140.47 |
| Polygonal deflecting surface 5a to surface to be scanned 8 | L total | 257.47 |

TABLE 3-continued

| Configuration of optical scanning apparatus | | |
|---|---|---|
| Sub-scanning decentration of lens 7 | shiftZ (mm) | 2.080 |
| Inclination decentration of lens 7 | RotZ (minute) | 0.579 |

| Shape of coupling lens 2 | | |
|---|---|---|
| | Incident surface 2a | Exit surface 2b |
| R | ∞ | −35.14 |

| Meridional shape of cylindrical lens 4 | | | Sagital shape of cylindrical lens 4 | | |
|---|---|---|---|---|---|
| | Incident surface 4a | Exit surface 4b | | Incident surface 4a | Exit surface 4b |
| R | ∞ | ∞ | Rs | 54.15 | ∞ |

| Meridional shape of fθ lens 6 | | | Sagital shape of fθ lens 6 | | |
|---|---|---|---|---|---|
| | Incident surface 6a Not light source side | Exit surface 6b Not light source side | | Incident surface 6a Not light source side | Exit surface 6b Not light source side |
| R | −7.18823E+01 | −4.27393E+01 | Rs | 6.98886E+02 | −4.47386E+01 |
| Ke | 3.16364E+00 | −2.82123E−01 | D2e | 0.00000E+00 | 4.55941E−05 |
| B4e | −2.87212E−07 | −3.94181E−07 | D4e | 0.00000E+00 | 9.03866E−08 |
| B6e | 7.66902E−09 | 1.98522E−09 | D6e | 0.00000E+00 | −5.34737E−11 |
| B8e | −8.20897E−12 | 5.21922E−13 | D8e | 0.00000E+00 | 0.00000E+00 |
| B10e | 3.20213E−15 | −1.62418E−15 | D10e | 0.00000E+00 | 0.00000E+00 |
| | Light source side | Light source side | | Light source side | Light source side |
| R | −7.18823E+01 | −4.27393E+01 | Rs | 6.98886E+02 | −4.47386E+01 |
| Ks | 3.16364E+00 | −2.82123E−01 | D2s | 0.00000E+00 | 1.64798E−05 |
| B4s | −2.87212E−07 | −3.94181E−07 | D4s | 0.00000E+00 | 6.29774E−08 |
| B6s | 7.66902E−09 | 1.98522E−09 | D6s | 0.00000E+00 | −3.00569E−11 |
| B8s | −8.20897E−12 | 5.21922E−13 | D8s | 0.00000E+00 | 0.00000E+00 |
| B10s | 3.20213E−15 | −1.62418E−15 | D10s | 0.00000E+00 | 0.00000E+00 |

| Meridional shape of fθ lens 7 | | | Sagital shape of fθ lens 7 | | |
|---|---|---|---|---|---|
| | Incident surface 7a Not light source side | Exit surface 7b Not light source side | | Incident surface 7a Not light source side | Exit surface 7b Not light source side |
| R | −2.63650E+03 | 5.48805E+02 | Rs | 2.64917E+02 | −4.22005E+01 |
| Ke | 0.00000E+00 | −1.72267E+02 | D2e | −4.87661E−05 | 9.96700E−05 |
| B4e | 0.00000E+00 | −1.73918E−07 | D4e | −1.36525E−08 | −1.80486E−08 |
| B6e | 0.00000E+00 | 1.22563E−11 | D6e | −7.86366E−13 | 6.38573E−12 |
| B8e | 0.00000E+00 | −5.98200E−16 | D8e | 3.40212E−16 | −9.75154E−16 |
| B10e | 0.00000E+00 | 1.24426E−20 | D10e | −1.12244E−20 | 9.61054E−20 |
| | Light source side | Light source side | | Light source side | Light source side |
| R | −2.63650E+03 | 5.48805E+02 | Rs | 2.64917E+02 | −4.22006E+01 |
| Ks | 0.00000E+00 | −1.72267E+02 | D2s | −4.87661E−05 | 7.94647E−05 |
| B4s | 0.00000E+00 | −1.73918E−07 | D4s | −1.36525E−08 | −3.10939E−09 |
| B6s | 0.00000E+00 | 1.22563E−11 | D6s | −7.86366E−13 | 2.59267E−13 |

TABLE 3-continued

| Configuration of optical scanning apparatus | | | | | |
|---|---|---|---|---|---|
| B8s | 0.00000E+00 | −5.98200E−16 | D8s | 3.40212E−16 | 1.30755E−16 |
| B10s | 0.00000E+00 | 1.24426E−20 | D10s | −1.12244E−20 | 2.11379E−20 |

TABLE 4

| Configuration of optical scanning apparatus | | |
|---|---|---|
| fθ coefficient, scanning width, field angle | | |
| fθ coefficient | k (mm/rad) | 200.00 |
| Scanning width | W (mm) | 310.00 |
| Maximum field angle | θ max (deg) | 44.40 |
| Wavelength, refractive index | | |
| Use wavelength | λ (nm) | 790.0 |
| Refractive index of coupling lens 2 | N1 | 1.76167 |
| Refractive index of cylindrical lens 4 | N2 | 1.52397 |
| Refractive index of fθ lens 6 | N3 | 1.52397 |
| Refractive index of fθ lens 7 | N4 | 1.52397 |
| Incident optical system, arrangement | | |
| Incident angle in main-scanning direction | α (deg) | 70.00 |
| Incident angle in sub-scanning direction | γ (deg) | −3.30 |
| Light source 1 to lens incident surface 2a | d0 (mm) | 45.81 |
| Lens incident surface 2a to lens exit surface 2b | d1 (mm) | 2.00 |
| Lens exit surface 2b to aperture stop 3 | d2 (mm) | 4.19 |
| Aperture stop 3 to lens incident surface 4a | d3 (mm) | 10.00 |
| Lens incident surface 4a to lens exit surface 4b | d4 (mm) | 3.00 |
| Lens exit surface 4b to deflection reference point C0 | d5 (mm) | 105.00 |
| Shape of aperture stop | | ellipsoid |
| Aperture stop diameter in main-scanning direction | eay (mm) | 4.60 |

TABLE 4-continued

| Configuration of optical scanning apparatus | | |
|---|---|---|
| Aperture stop diameter in sub-scanning direction | eaz (mm) | 2.90 |
| Light deflector | | |
| Number of surfaces of polygon | | 5 |
| Radius of circumcircle | Rpol (mm) | 17 |
| Rotation center to deflection reference point C0 (X direction) | Xpol (mm) | 11.945 |
| Rotation center to deflection reference point C0 (Y direction) | Ypol (mm) | 6.918 |
| Scanning optical system, arrangement | | |
| Deflection reference point C0 to lens incident surface 6a | L0 (mm) | 27.70 |
| Lens incident surface 6a to lens exit surface 6b | L1 (mm) | 9.00 |
| Lens exit surface 6b to lens incident surface 7a | L2 (mm) | 75.30 |
| Lens incident surface 7a to lens exit surface 7b | L3 (mm) | 5.00 |
| Lens exit surface 7b to surface to be scanned 8 | L4 (mm) | 115.00 |
| Polygonal deflecting surface 5a to surface to be scanned 8 | L total | 232.00 |
| Sub-scanning decentration of lens 7 | shiftZ (mm) | −2.333 |
| Inclination decentration of lens 7 | RotZ (minute) | 0.562 |

TABLE 4-continued

| Configuration of optical scanning apparatus | | | | | |
|---|---|---|---|---|---|
| Shape of coupling lens 2 | | | | | |
| | Incident surface 2a | Exit surface 2b | | | |
| R | ∞ | −35.14 | | | |
| Meridional shape of cylindrical lens 4 | | | Sagital shape of cylindrical lens 4 | | |
| | Incident surface 4a | Exit surface 4b | | Incident surface 4a | Exit surface 4b |
| R | ∞ | ∞ | Rs | 58.05 | ∞ |
| Meridional shape of fθ lens 6 | | | Sagital shape of fθ lens 6 | | |
| | Incident surface 6a Not light source side | Exit surface 6b Not light source side | | Incident surface 6a Not light source side | Exit surface 6b Not light source side |
| R | −7.18823E+01 | −4.27393E+01 | Rs | 6.98886E+02 | −4.47386E+01 |
| Ke | 3.16364E+00 | −2.28123E−01 | D2e | 0.00000E+00 | 4.55941E−05 |
| B4e | −2.87212E−07 | −3.94181E−07 | D4e | 0.00000E+00 | 9.03866E−08 |
| B6e | 7.66902E−09 | 1.98522E−09 | D6e | 0.00000E+00 | −5.34737E−11 |
| B8e | −8.20897E−12 | 5.21922E−13 | D8e | 0.00000E+00 | 0.00000E+00 |
| B10e | 3.20213E−15 | −1.62418E−15 | D10e | 0.00000E+00 | 0.00000E+00 |
| | Light source side | Light source side | | Light source side | Light source side |
| R | −7.18823E+01 | −4.27393E+01 | Rs | 6.98886E+02 | −4.47386E+01 |
| Ks | 3.16364E+00 | −2.28123E−01 | D2s | 0.00000E+00 | 1.64798E−05 |
| B4s | −2.87212E−07 | −3.94181E−07 | D4s | 0.00000E+00 | 6.29774E−08 |
| B6s | 7.66902E−09 | 1.98522E−09 | D6s | 0.00000E+00 | −3.00569E−11 |
| B8s | −8.20897E−12 | 5.21922E−13 | D8s | 0.00000E+00 | 0.00000E+00 |
| B10s | 3.20213E−15 | −1.62418E−15 | D10s | 0.00000E+00 | 0.00000E+00 |
| Meridional shape of fθ lens 7 | | | Sagital shape of fθ lens 7 | | |
| | Incident surface 7a Not light source side | Exit surface 7b Not light source side | | Incident surface 7a Not light source side | Exit surface 7b Not light source side |
| R | −2.06855E+03 | 4.65869E+02 | Rs | 1.89314E+02 | −3.96233E+01 |
| Ke | 0.00000E+00 | −1.42210E+02 | D2e | −4.53724E−05 | 1.06739E−04 |
| B4e | 0.00000E+00 | −1.74405E−07 | D4e | −1.08544E−08 | −1.86714E−08 |
| B6e | 0.00000E+00 | 1.02405E−11 | D6e | 7.08346E−13 | 6.09467E−12 |
| B8e | 0.00000E+00 | −3.97478E−16 | D8e | 3.05438E−19 | −8.91350E−16 |
| B10e | 0.00000E+00 | 5.20992E−21 | D10e | 2.38638E−21 | 7.58658E−20 |
| | Light source side | Light source side | | Light source side | Light source side |
| R | −2.06855E+03 | 4.65869E+02 | Rs | 1.89314E+02 | −3.96233E+01 |
| Ks | 0.00000E+00 | −1.42210E+02 | D2s | −4.53724E−05 | 8.79055E−05 |
| B4s | 0.00000E+00 | −1.74405E−07 | D4s | −1.08544E−08 | −6.81954E−09 |
| B6s | 0.00000E+00 | 1.02405E−11 | D6s | 7.08346E−13 | 1.87099E−12 |
| B8s | 0.00000E+00 | −3.97478E−16 | D8s | 3.05438E−19 | −2.31968E−16 |
| B10s | 0.00000E+00 | 5.20992E−21 | D10s | 2.38638E−21 | 3.66951E−20 |

Herein, Table 3 shows lens shapes and arrangement of the imaging optical system SC, and Table 4 shows lens shapes and arrangement of the imaging optical system SD.

Figure 12A:
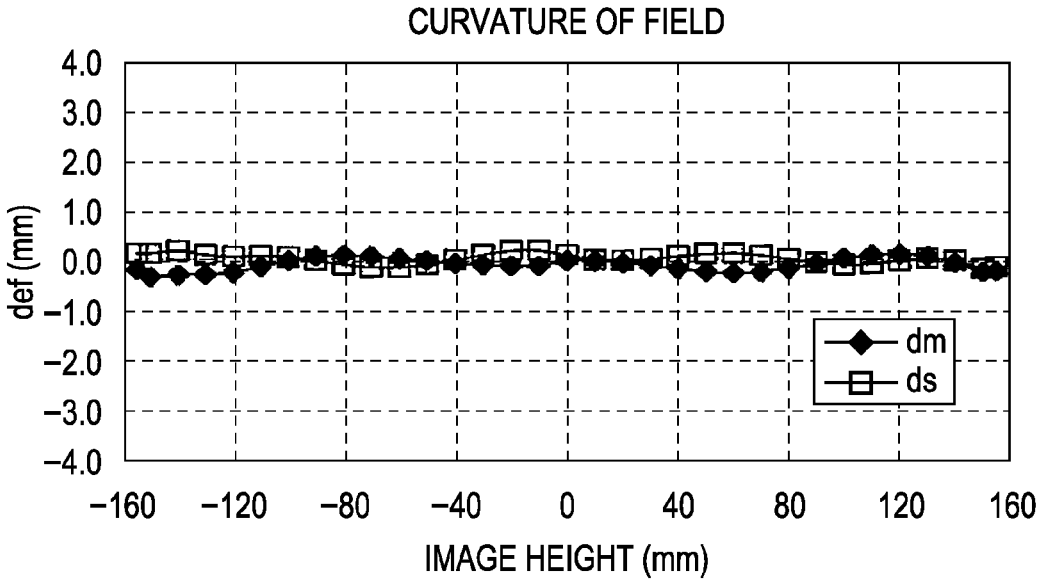
FIG. 12A is a graph showing a curvature of field according to the second embodiment of the present invention.
Figure 12B:
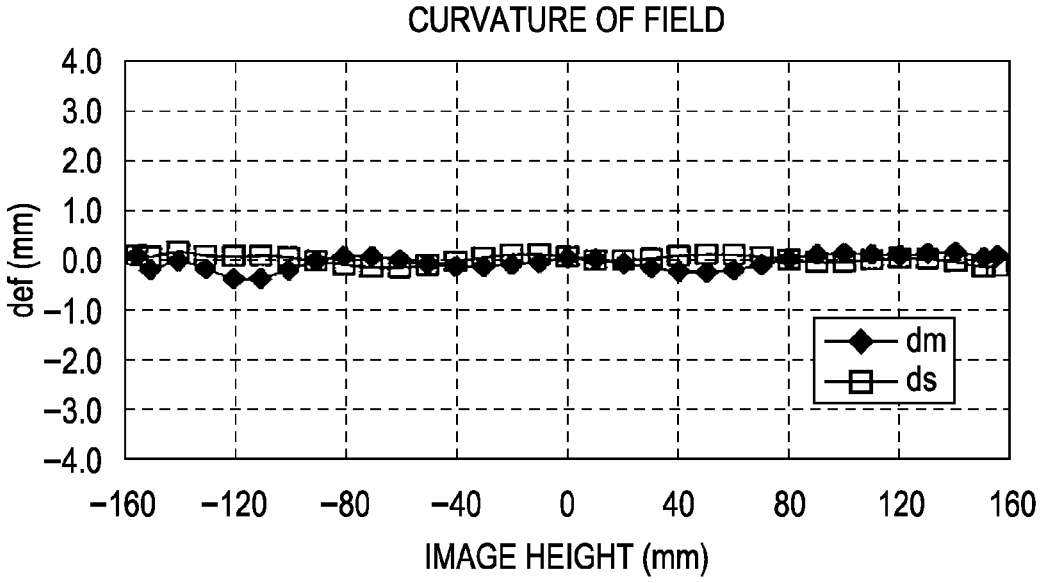
FIG. 12B is a graph showing a curvature of field according to the second embodiment of the present invention.

FIGS. 12A and 12B are graphs showing curvatures of field in the main-scanning direction and the sub-scanning direction according to the second embodiment of the present invention.

FIGS. 12A, 13A, 14A, 15A, and 16A exhibit optical performances of the imaging optical system SC, whereas FIGS. 12B, 13B, 14B, 15B, and 16B exhibit optical performances of the imaging optical system SD.

In the imaging optical system SC, a curvature of field dm in the main-scanning direction is 0.47 mm, and a curvature of field ds in the sub-scanning direction is 0.34 mm in an effective width of an image (W=310 mm).

In the imaging optical system SD, a curvature of field dm in the main-scanning direction is 0.54 mm, and a curvature of field ds in the sub-scanning direction is 0.33 mm. Thus, it is found that both the curvatures of field are corrected.

Figure 13A:
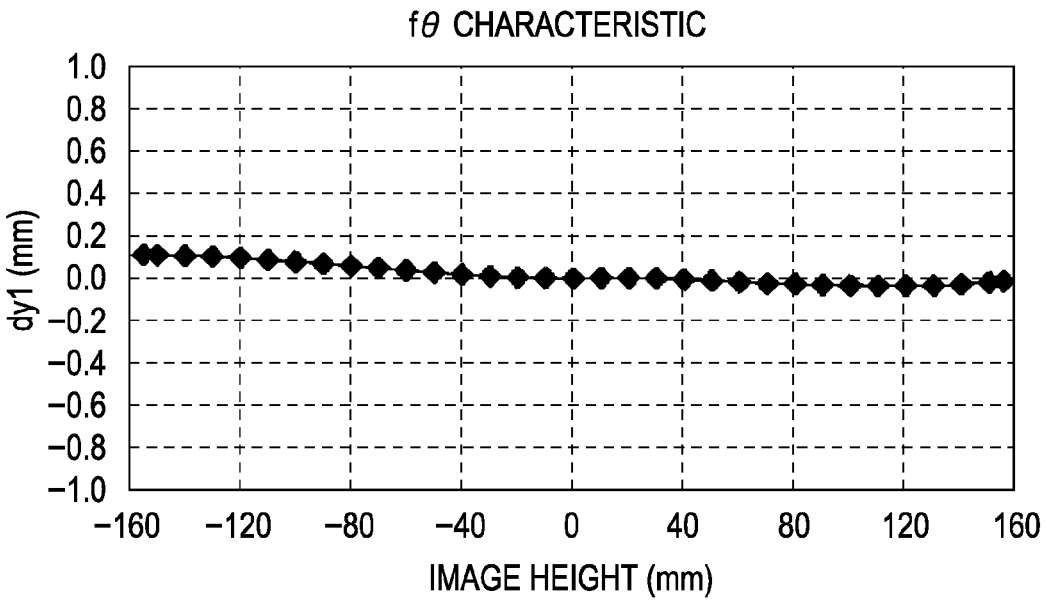
FIG. 13A is a graph showing an imaging position deviation in the main-scanning direction according to the second embodiment of the present invention.
Figure 13B:
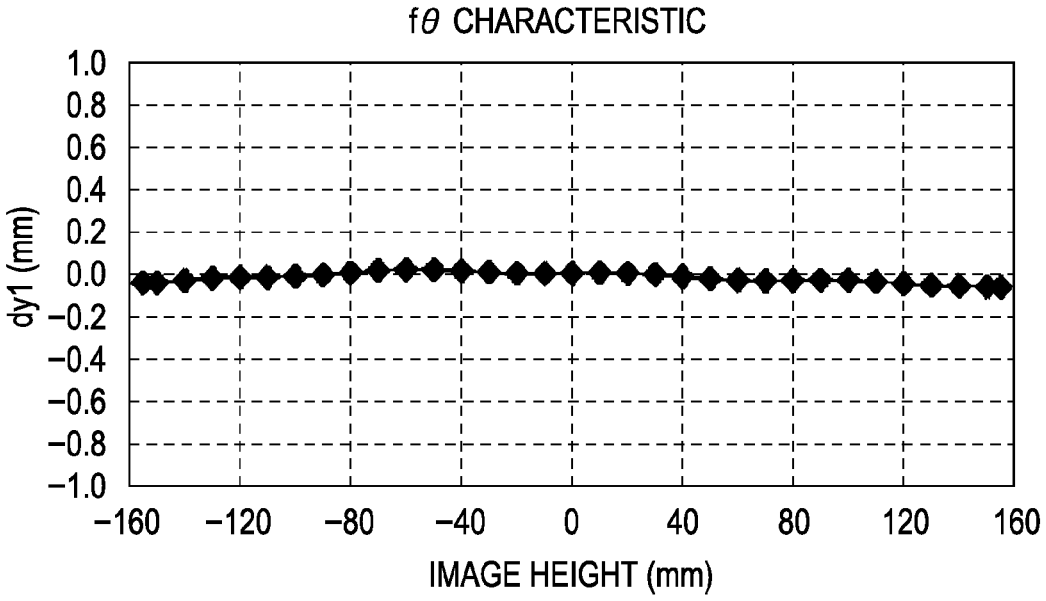
FIG. 13B is a graph showing an imaging position deviation in the main-scanning direction according to the second embodiment of the present invention.

FIGS. 13A and 13B are graphs showing fθ characteristics dy1 according to the second embodiment of the present invention.

The fθ characteristics dy1 is a difference obtained when an ideal image height is subtracted from a position where the light beam actually reaches.

The imaging optical system SC causes a shift of 116 μm at maximum, and the imaging optical system SD causes a shift of 74 μm at maximum.

If the imaging optical systems SC and SD are used without the shifts being corrected, the shifts may cause color misregistration to occur in the main-scanning direction.

Owing to this, to reduce the fθ characteristic dy1, it is desirable to change an image clock in accordance with each image height.

The insufficiency of correction of the fθ characteristic can be electrically corrected by changing the image clock. However, if the shift of the fθ characteristic becomes too large, the spot diameter in the main-scanning direction would be changed.

In this embodiment, the shift of the fθ characteristic to be generated would not cause the spot diameter to be markedly changed. Hence, even when a latent image is formed onto a photosensitive drum with the optical scanning apparatus of this embodiment, the shift would not cause color-density unevenness of an image to occur.

Figure 14A:
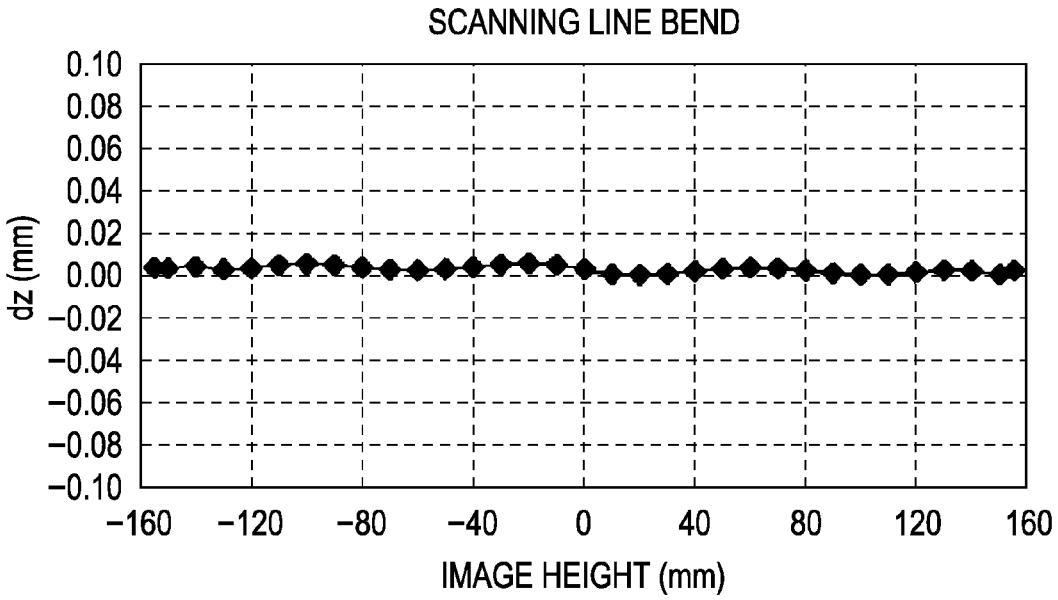
FIG. 14A is a graph showing a scanning line bend according to the second embodiment of the present invention.
Figure 14B:
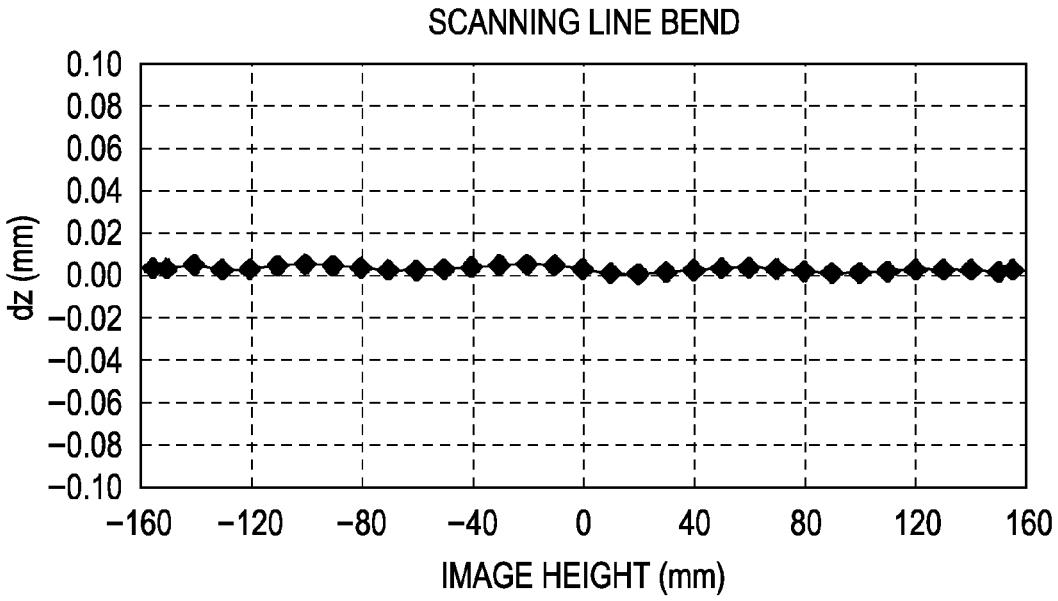
FIG. 14B is a graph showing a scanning line bend according to the second embodiment of the present invention.

FIGS. 14A and 14B are graphs each showing a scanning line bend dz according to the second embodiment of the present invention.

A scanning line bend dz is expressed by a difference obtained when an imaging position in the sub-scanning direction at the center of an image is subtracted from an imaging position in the sub-scanning direction at each image height.

The imaging optical system SC causes a shift of 5 μm at maximum, and the imaging optical system SD causes a shift of 4 μm at maximum.

Both the shifts are easily ignored in images.

In this embodiment, the imaging lens 7C is rotated clockwise around the optical axis as a rotation axis by 0.579 minutes when seen from the light deflector 5.

Also, the imaging lens 7D is rotated counterclockwise around the optical axis as a rotation axis by 0.562 minutes when seen from the light deflector 5.

Accordingly, an inclination of a scanning line is corrected.

Figure 15A:
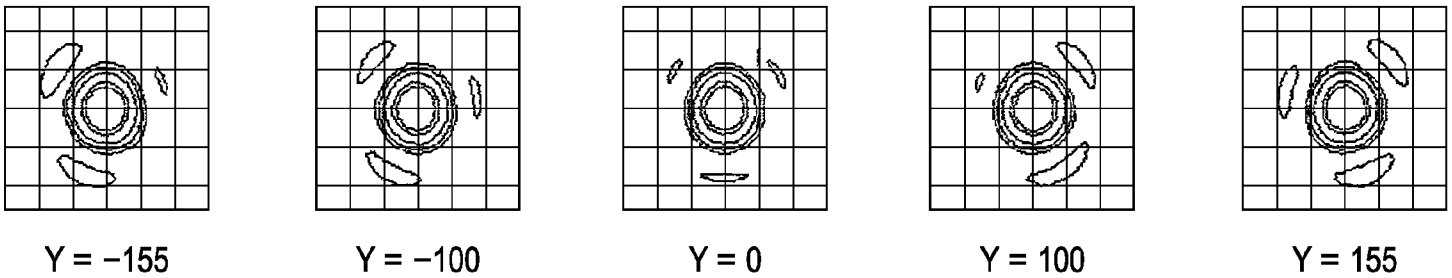
FIG. 15A shows a spot profile according to the second embodiment of the present invention.
Figure 15B:
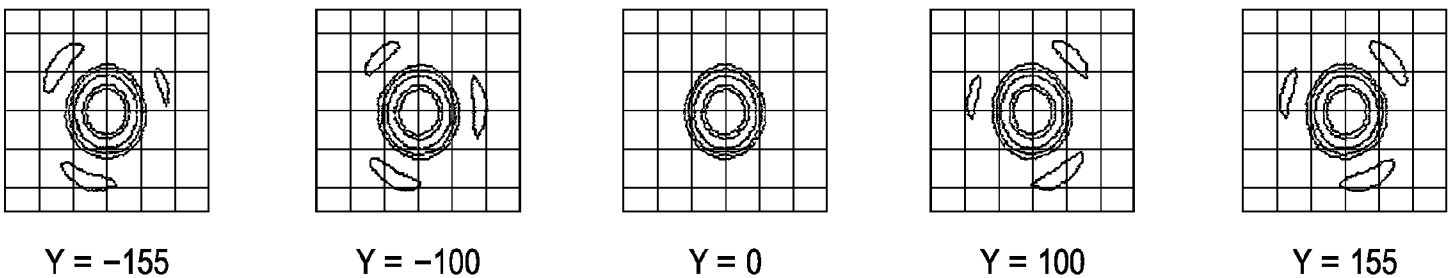
FIG. 15B shows a spot profile according to the second embodiment of the present invention.

FIGS. 15A and 15B are explanatory illustrations each showing cross sections of spots at respective image heights.

FIGS. 15A and 15B illustrate cross sections sliced with 2%, 5%, 10%, 13.5%, 36.8%, and 50% of the peak light power at a spot of an image height.

Normally, with the optical scanning apparatus in which a light beam is obliquely incident within the sub-scanning cross section, a spot may be deformed as a result of torsion of wavefront aberration.

In this embodiment, the torsion of wavefront aberration is reduced by optimizing power arrangement of respective surfaces, and tilt and shift amounts of a lens.

In the imaging optical system SC, to correct the wavefront aberration, the imaging lens 7C is shifted in the sub-scanning direction by 2.08 mm with respect to the plane P0.

In the imaging optical system SD, to correct the wavefront aberration, the imaging lens 7D is shifted in the sub-scanning direction by 2.33 mm with respect to the plane P0.

Accordingly, the complete spot profile without deformation can be provided at any image height.

Figure 16A:
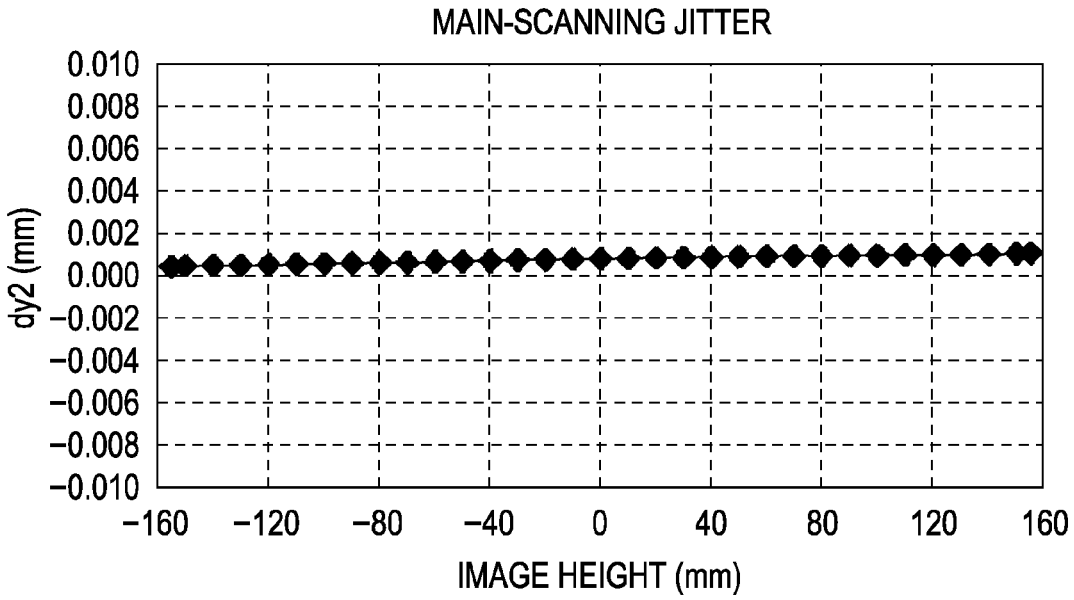
FIG. 16A is a graph showing a jitter in the main-scanning direction according to the second embodiment of the present invention.
Figure 16B:
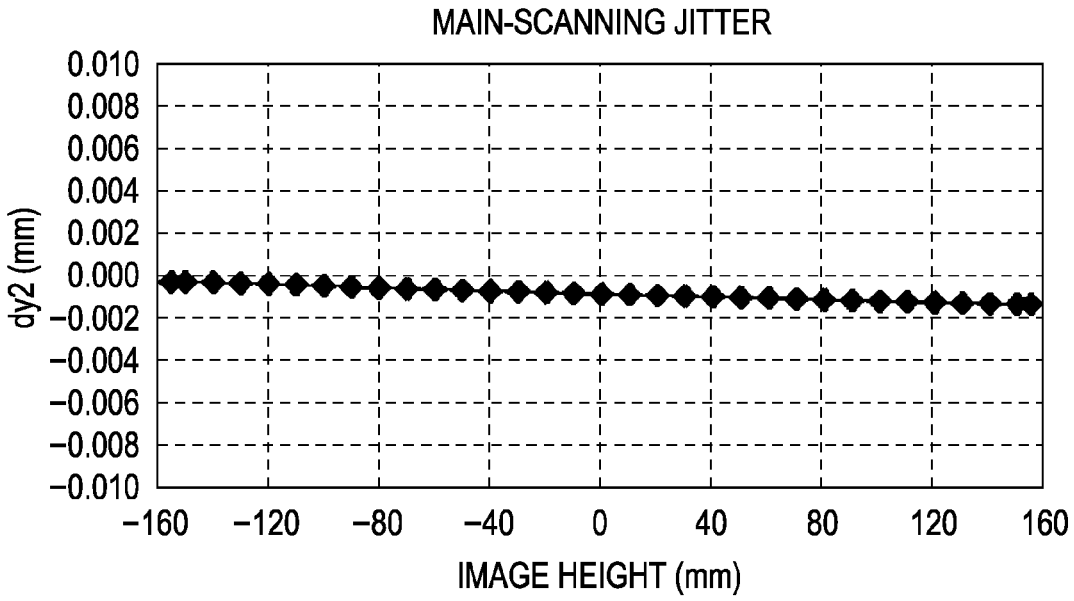
FIG. 16B is a graph showing a jitter in the main-scanning direction according to the second embodiment of the present invention.

FIGS. 16A and 16B are explanatory illustrations each showing a jitter dy2 in the main-scanning direction when a deflective reflection surface has a shift decentration error of 10 μm.

The imaging optical system SC has a jitter in the main-scanning direction of 1.0 μm at maximum, and the imaging optical system SD has a jitter of 1.4 μm at maximum. Thus, the jitters can be restricted and are easily ignored.

In the above-described design example, the distance from the light deflector 5 to the imaging lens 7A and the distance from the light deflector 5 to the imaging lens 7B respectively correspond to the distance from the light deflector 5 to the imaging lens 7C and the distance from the light deflector 5 to the imaging lens 7D.

In this embodiment, the freedom of arrangement is further enhanced by changing the distance from the light deflector to the imaging lens located close to the surface to be scanned.

FIGS. 17A to 17D are main-scanning cross sections of imaging optical systems SC in which a distance from the light deflector 5 to the imaging lens 7C is designed to be varied.

Figure 17A:
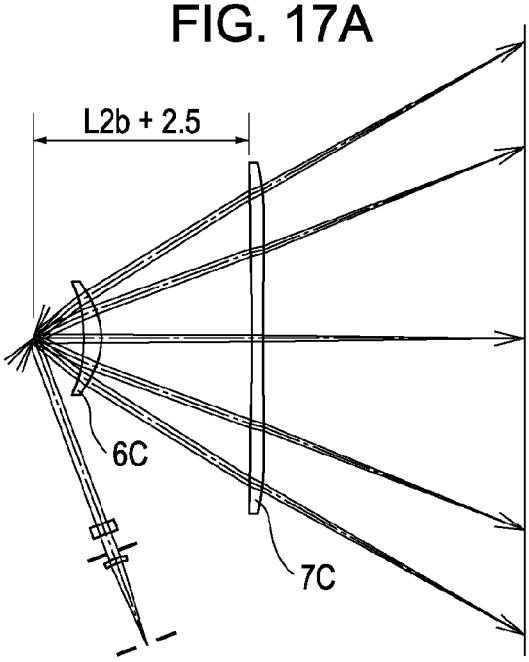
FIGS. 17A-D are explanatory illustrations showing a shape of an imaging lens when a distance from a light deflector to an imaging lens is changed.
Figure 17B:
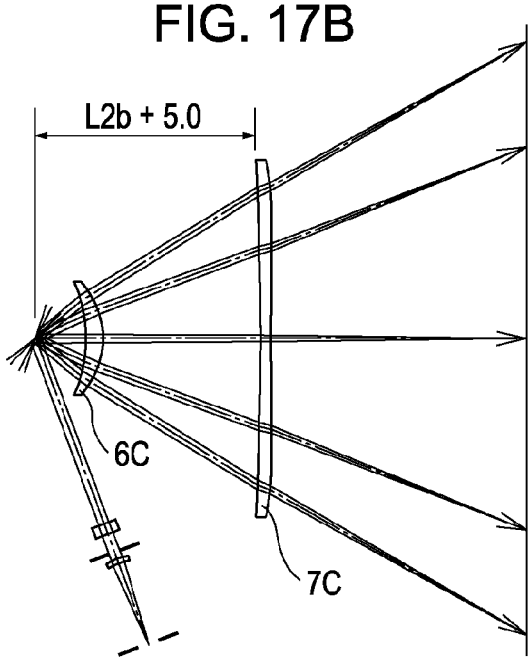

A distance from the light deflector 5 to the imaging lens 7C is 2.5 mm in FIG. 17A. A distance from the light deflector 5 to the imaging lens 7C is 5.0 mm in FIG. 17B.

Figure 17C:
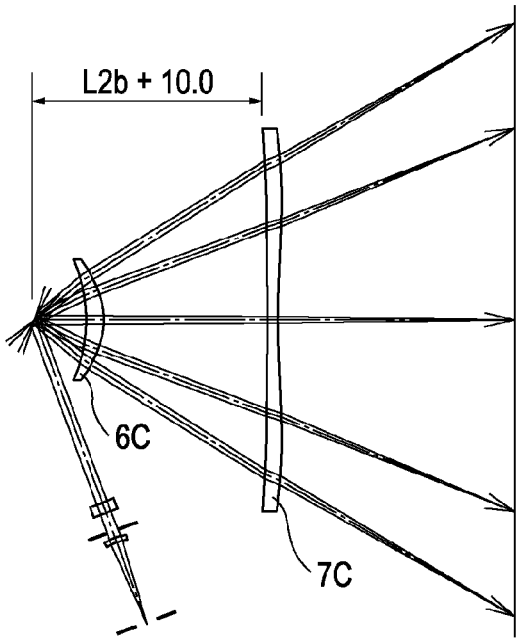
Figure 17D:
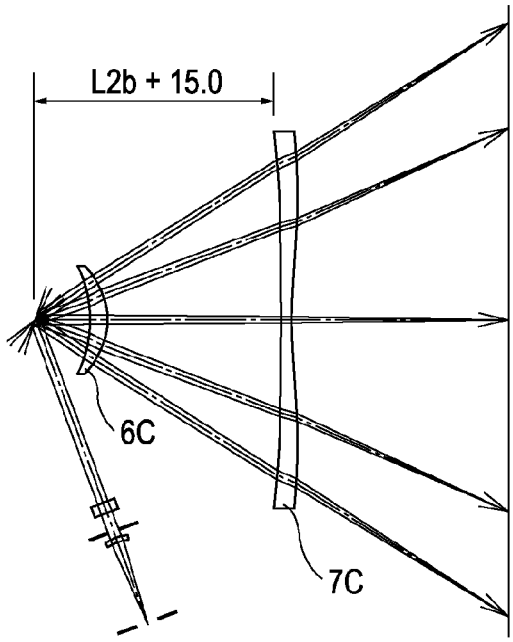

A distance from the light deflector 5 to the imaging lens 7C is 10.0 mm in FIG. 17C. A distance from the light deflector 5 to the imaging lens 7C is 15.0 mm in FIG. 17D.

The thickness of an end portion of the imaging lens 7C is increased when the distance is 10.0 mm or larger.

As the thickness of the lens is increased, a molding-tact time (one cycle time of molding) of the lens is increased. Thus, such a configuration does not meet the concept of providing a compact optical scanning apparatus with the reduced number of optical components.

The thickness of the lens may be increased because a change in curvature of field dm and a change in fθ characteristic dy1 in the main-scanning direction as a result of a change in distance between lenses is corrected merely by the shape of the imaging lens 7C.

Thus, when the imaging lens 6C is shared by the two imaging optical systems, the difference between the lenses has to be regulated.

Regarding this, in this embodiment, when the Kθ coefficient of the imaging optical system with the long optical path length is assumed to be $K_2$ (mm/rad), the distance from the light deflector to the lens located closest to the surface to be scanned is set to $0.05K_2$ or smaller.

In this embodiment, since $K_2$=220 (mm/rad), as long as the difference between the distances from the light deflector 5 to the imaging lenses 7C and 7D located close to the surface to be scanned in the imaging optical systems SC and SD is 11 mm or smaller, the freedom of arrangement can be enhanced.

Third Embodiment

Figure 18:
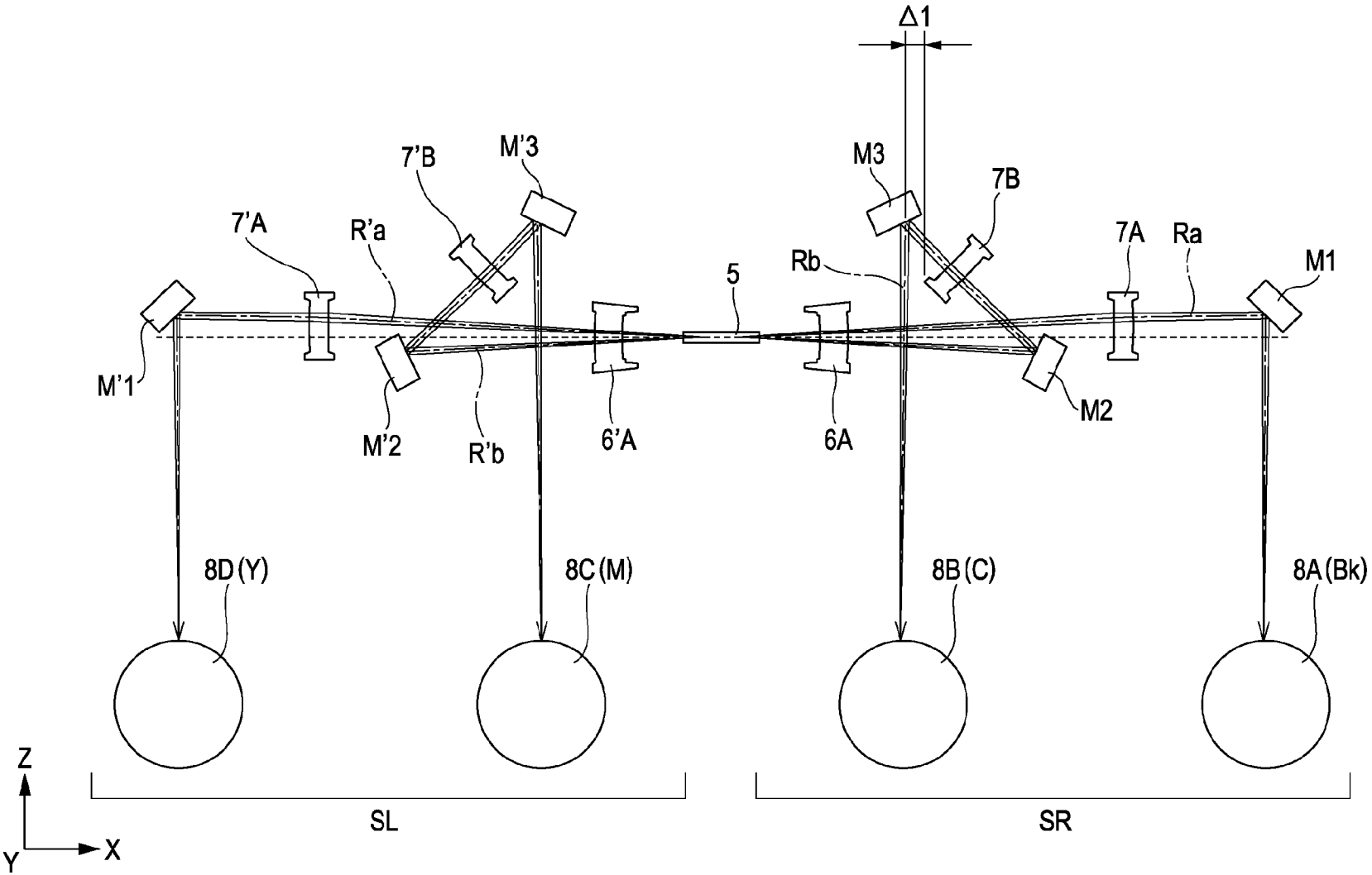
FIG. 18 illustrates a sub-scanning cross section of an optical scanning apparatus according to a third embodiment of the present invention.

FIG. 18 illustrates a sub-scanning cross section of an optical scanning apparatus according to a third embodiment of the present invention.

In the drawing, like reference numerals refer like components as in FIG. 1.

This embodiment is different from the first and second embodiments in that the light beams Rb and R'b in the imaging optical systems SB and SC that form images onto the photosensitive drum surfaces 8B and 8C located close to the light deflector (deflecting unit) 5 intersect with that light beam within the sub-scanning cross section.

Other configurations and optical effects are similar to those of the first and second embodiments. Thus, similar advantages can be obtained.

In this embodiment, the optical path lengths of the imaging optical systems SB and SC that form images onto the photosensitive drum surfaces 8B and 8C located close to the light deflector 5 are longer than the optical path lengths of the imaging optical systems SA and SD that form images onto the photosensitive drum surfaces 8A and 8D located far from the light deflector 5.

Accordingly, the freedom of arrangement of the imaging lenses 7B and 7'B is enhanced.

Figure 19:
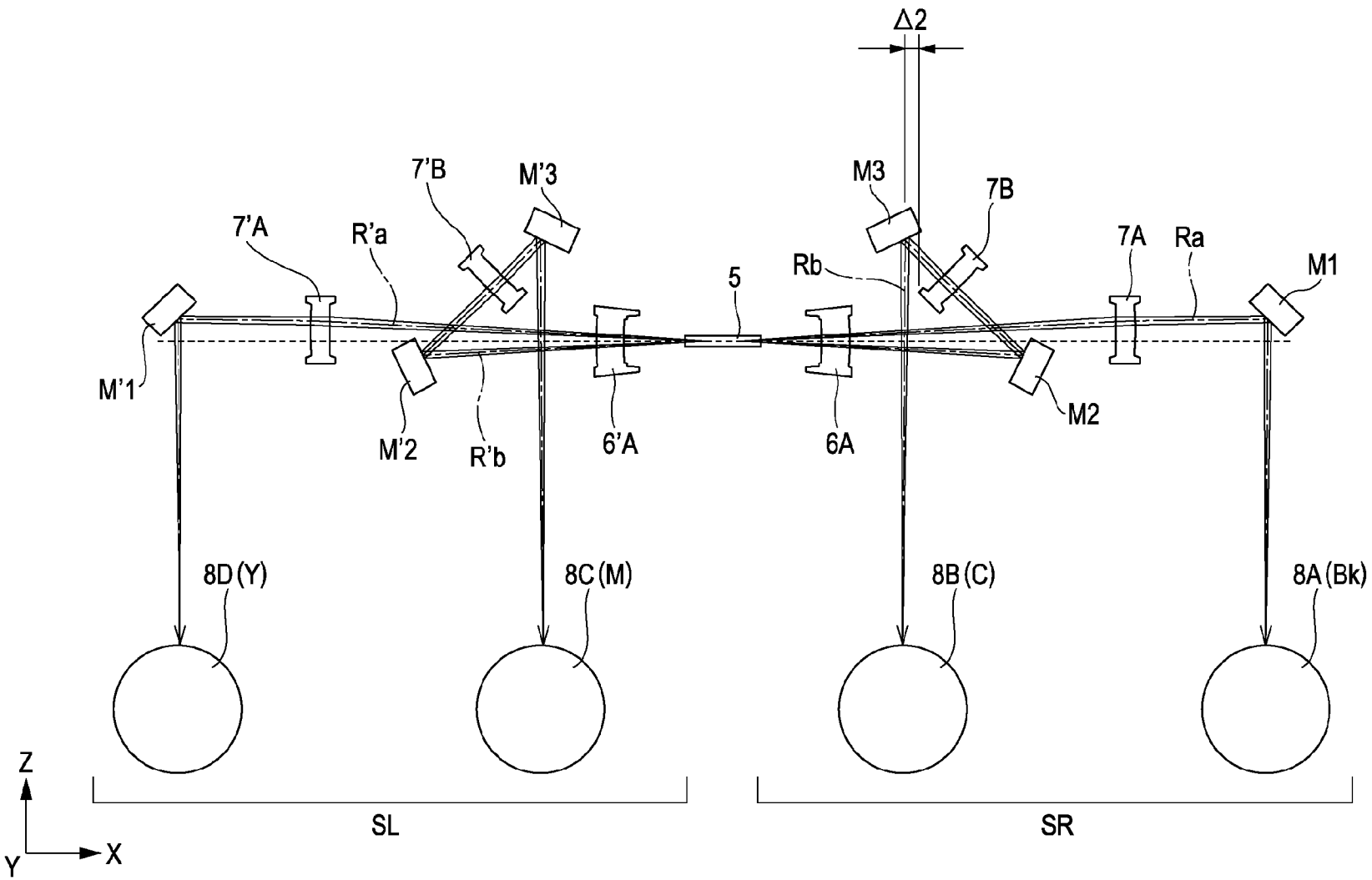
FIG. 19 illustrates a sub-scanning cross section of an optical scanning apparatus according to a comparative example of the third embodiment of the present invention.

FIG. 19 is a sub-scanning cross section of a comparative example of the present invention.

In the comparative example, the optical path length of the imaging optical system SA (SD) is equal to that of the imaging optical system SB (SC).

The two scanning units SR and SL have similar configurations and optical effects, and hence, to avoid redundant description, the scanning unit SR will be mainly described below.

In the comparative example, a design clearance 42 from the imaging lens 7B to a light beam (scanning light beam) Rb is small as Δ2=2.04 mm.

Owing to this, the imaging lens 7B may interfere with the light beam Rb as a result of torsion of rays caused by attachment of an optical component, such as a lens or a mirror, or as a result of torsion of rays caused by deformation of a housing over an environmental change.

In the third embodiment, the optical path length (171.3 mm) of the imaging optical system SB corresponding to the light beam Rb is set longer than the optical path length (161.1 mm) of the imaging optical system SA corresponding to the light beam Ra by 10.2 mm.

Accordingly, the clearance Δ1 between the light beam Rb and the imaging lens 7B is large as Δ1=3.43 mm, which is about 1.7 times the clearance of the comparative example.

While the distance between the surfaces to be scanned (distance between photosensitive drum surfaces) is fixed to 69 mm in this embodiment, the range of the distance between the surfaces to be scanned can be widened as long as the optical path lengths involve a difference therebetween as in this embodiment.

Color Image Forming Apparatus

Figure 20:
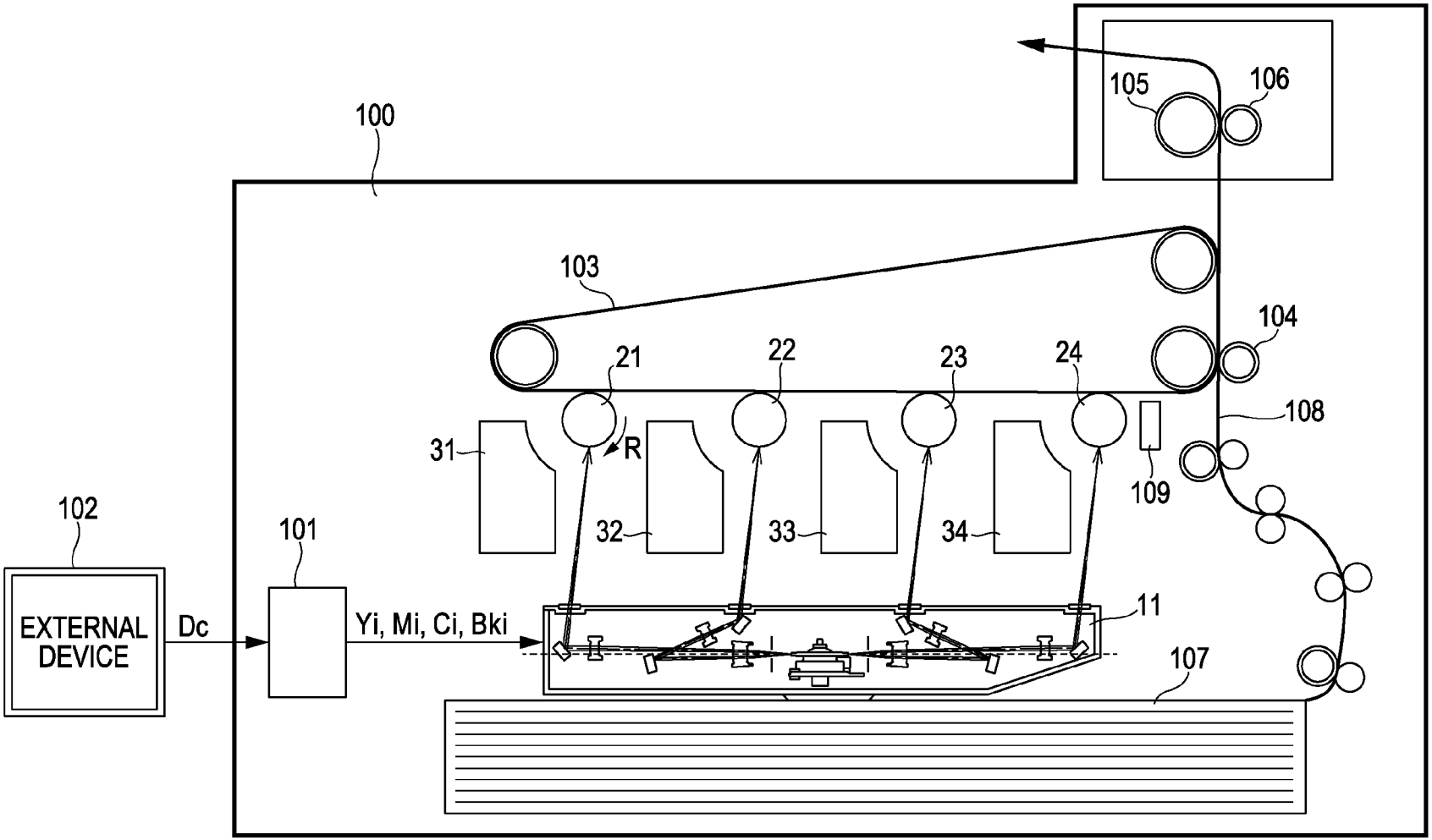
FIG. 20 is a schematic illustration showing a primary portion of a color image forming apparatus according to an embodiment of the present invention.
Figure 21:
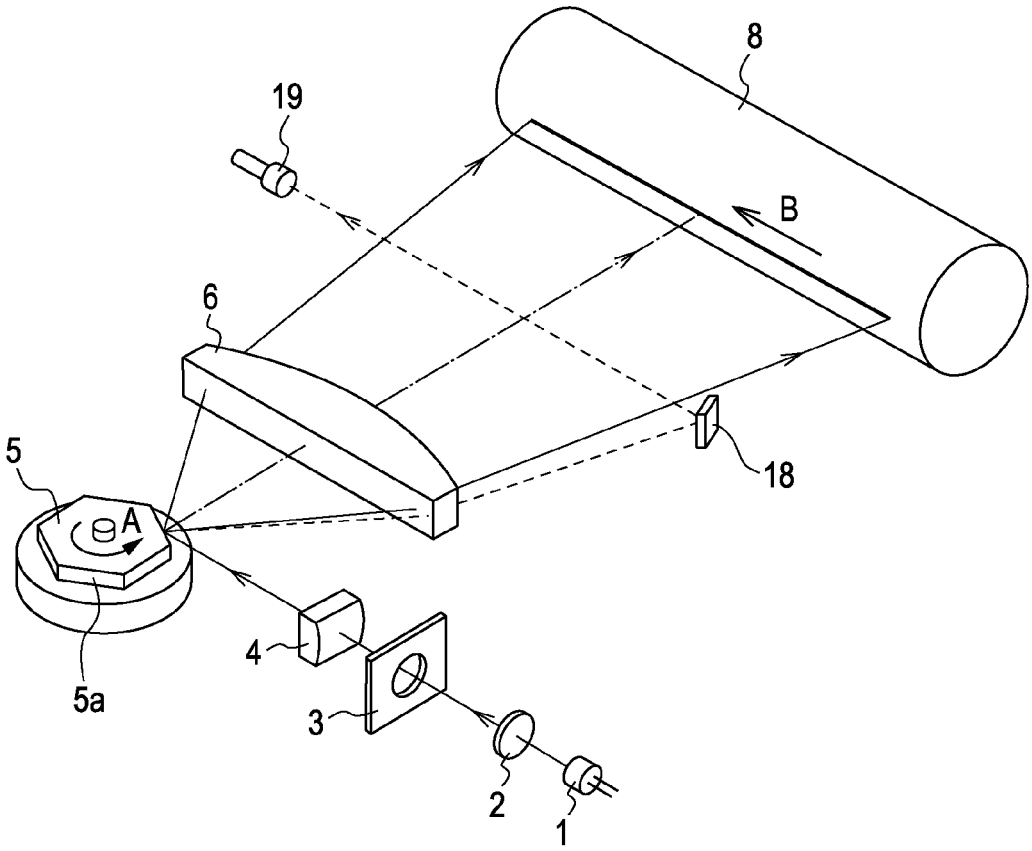
FIG. 21 PRIOR ART
FIG. 21 is a perspective view showing a primary portion of an optical scanning apparatus according to a related art example.
Figure 22:
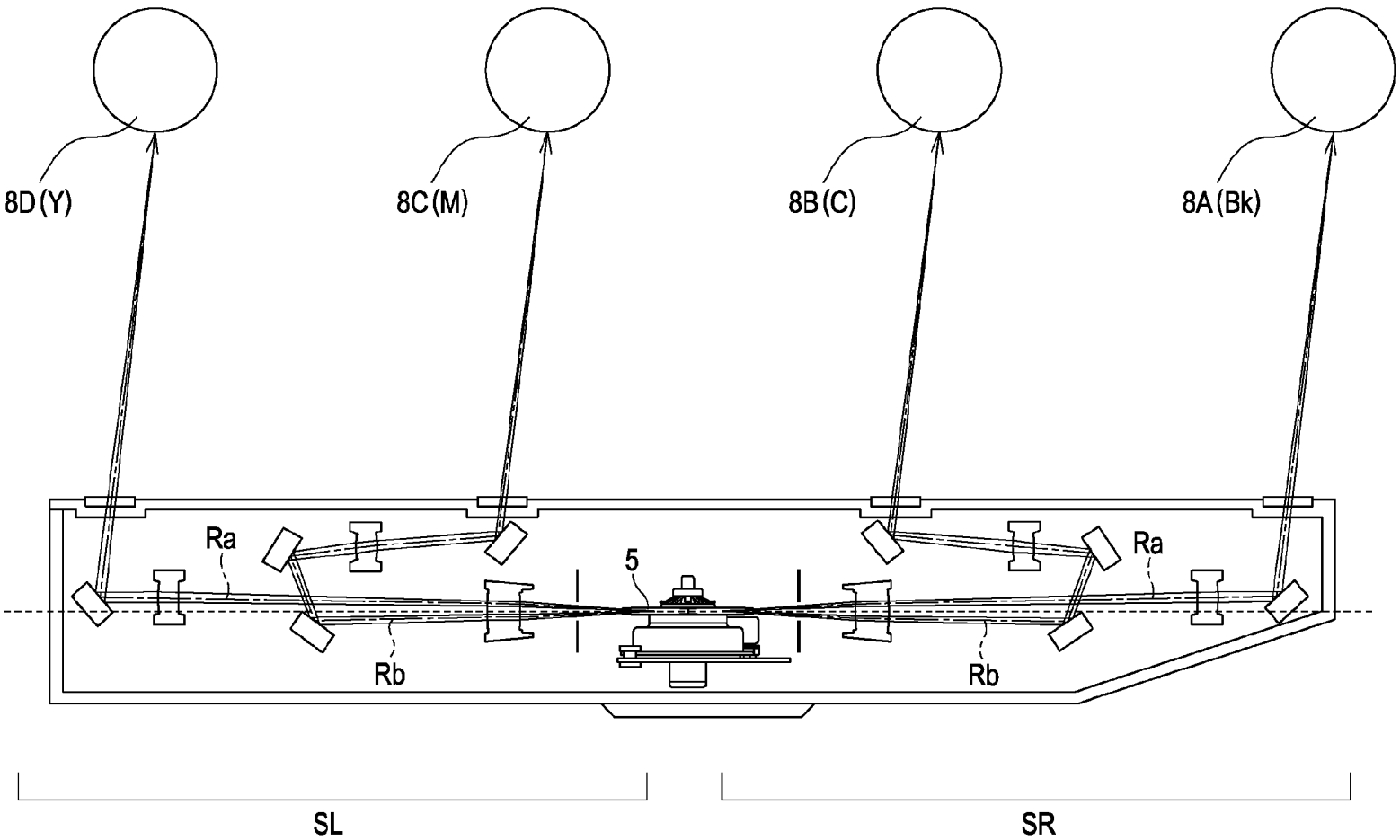
FIG. 22 PRIOR ART
FIG. 22 illustrates a sub-scanning cross section of an optical scanning apparatus according to a related art example.

FIG. 20 is a cross section in a sub-scanning direction of a primary portion of a color image forming apparatus according to an embodiment of the present invention.

In the drawing, reference numeral 100 denotes a color image forming apparatus.

An external device 102 such as a personal computer inputs code data (color signals of R, G, and B) Dc to the color image forming apparatus 100.

A printer controller 101 provided in the apparatus converts the code data Dc into image data of different colors of Yi (yellow), Mi (magenta), Ci (cyan), and Bki (black). The converted image data is input to an optical scanning apparatus 11 having a configuration described in any of the first to third embodiments.

The optical scanning apparatus 11 emits light beams which have been modulated in accordance with the image data Yi, Mi, Ci, and Bki. The light beams scan photosensitive surfaces of photosensitive drums 21 to 24 in the main-scanning direction.

The photosensitive drums 21 to 24 serving as electrostatic latent image bearing members (photosensitive members) are rotated clockwise (in R direction) by a motor (not shown).

With the rotation, the photosensitive surfaces of the photosensitive drums 21 to 24 are moved in the sub-scanning direction orthogonal to the main-scanning direction with respect to a light beam.

Charging rollers (not shown) are provided above the photosensitive drums 21 to 24 to come into contact with the photosensitive drums 21 to 24. The charging rollers uniformly charge the surfaces of the photosensitive drums 21 to 24.

The surfaces of the photosensitive drums 21 to 24 charged with the charging rollers are irradiated with the light beams for scanning by the optical scanning apparatus 11.

As described above, the light beams are modulated in accordance with the image data Yi, Mi, Ci, and Bki. When the surfaces of the photosensitive drums 21 to 24 are irradiated with the light beams, electrostatic latent images are formed thereon.

Developing units 31 to 34 are respectively arranged downstream of the photosensitive drums 21 to 24 in the rotation directions thereof with respect to the irradiation positions of the light beams, so as to come into contact with the photosensitive drums 21 to 24. The developing units 31 to 34 develop the electrostatic latent images into toner images.

An intermediate transfer belt 103 is arranged above the photosensitive drums 21 to 24 to face the photosensitive drums 21 to 24. The four color toner images developed by the developing units 31 to 34 are transferred onto the intermediate transfer belt 103 and are formed as a color image.

The color toner image formed onto the intermediate transfer belt 103 is transferred onto a sheet 108 serving as a member to be transferred by a transferring roller (transferring unit) 104.

The sheet 108 is stored in a sheet cassette 107.

The sheet 108 on which an unfixed toner image is transferred is conveyed to a fixing unit.

The fixing unit includes a fixing roller 105 having a fixing heater (not shown) therein, and a pressure roller 106 arranged to press the fixing roller 105.

The sheet 108, which has been conveyed from a transferring portion, is pressed and heated by a pressing portion defined by the fixing roller 105 and the pressure roller 106 to fix the unfixed toner image to the sheet 108.

The sheet 108 with the image fixed is discharged to the outside of the image forming apparatus.

A registration sensor 109 reads registration marks of Y, M, C, and Bk formed on the intermediate transfer belt 103, so as to detect an amount of color misregistration.

The detected result is fed back to the optical scanning apparatus 11. Thus, a high-quality color image without color misregistration can be formed.

Though not shown in FIG. 20, the printer controller 101 controls the portions in the image forming apparatus and the motor for the polygonal mirror provided in the optical scanning apparatus in addition to the above-described conversion of data.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. An optical scanning apparatus comprising:

first and second light sources configured to emit first and second divergent light beams respectively;

first and second incident optical systems respectively provided in correspondence with the first and second divergent light beams;

a deflecting unit having a first deflecting surface configured to deflect the light beams through the first and second incident optical systems respectively; and first and second imaging optical systems configured to guide the light beams deflected by the first deflecting surface of the deflecting unit onto first and second surfaces to be scanned respectively, wherein the first and second divergent light beams have a same wavelength, wherein the first incident optical system converts the first divergent light beam into a light beam with higher convergence than convergence of the first divergent light beam, and the second incident optical system converts the second divergent light beam into a light beam with convergence higher than convergence of the second divergent light beam and lower than the convergence of the light beam converted from the first divergent light beam, wherein an optical path length from a deflection point of the deflecting unit to the first surface to be scanned is shorter than an optical path length from a deflection point of the deflecting unit to the second surface to be scanned, and the following condition is satisfied:

$$0.85<K1/K2<0.98$$

where K1 is a Kθ coefficient of the first imaging optical system, and K2 is a Kθ coefficient of the second imaging optical system.

2. The optical scanning apparatus according to claim 1, wherein the first incident optical system converts the first divergent light beam into a convergent light beam, and the second incident optical system converts the second divergent light beam into a divergent light beam.

3. The optical scanning apparatus according to claim 1, further comprising:

third and fourth light sources configured to emit third and fourth divergent light beams respectively;

third and fourth incident optical systems respectively provided in correspondence with the third and fourth divergent light beams;

third and fourth imaging optical systems configured to guide the light beams deflected by a second deflecting surface, which is different from the first deflecting surface, of the deflecting unit onto third and fourth surfaces to be scanned respectively, wherein the third and fourth divergent light beams have a same wavelength, wherein the third incident optical system converts the third divergent light beam into a light beam with higher convergence than convergence of the third divergent light beam, and the fourth incident optical system converts the fourth divergent light beam into a light beam with convergence higher than convergence of the fourth divergent light beam and lower than the convergence of the light beam converted from the third divergent light beam, wherein an optical path length from a deflection point of the deflecting unit to the third surface to be scanned is shorter than an optical path length from a deflection point of the deflecting unit to the fourth surface to be scanned, and where a Kθ coefficient of the third imaging optical system is K1 too, and a Kθ coefficient of the fourth imaging optical system is K2 too.

4. The optical scanning apparatus according to claim 3, wherein the first and third incident optical systems respectively convert the first and third light beams into convergent light beams, and the second and fourth incident optical systems respectively convert the second and fourth light beams into divergent light beams.

5. An image forming apparatus comprising:

the optical scanning apparatus according to claim 1;

first and second photosensitive members disposed at the first and second surfaces to be scanned;

first and second developing units configured to develop electrostatic latent images, which are formed on the first and second photosensitive members with light beams for scanning by the optical scanning apparatus, into toner images;

first and second transferring units configured to transfer the developed toner images onto a printable member; and a fixing unit configured to fix the transferred toner images to the printable member.

* * * * *